US008287068B2

(12) United States Patent
Shimizu et al.

(10) Patent No.: US 8,287,068 B2
(45) Date of Patent: Oct. 16, 2012

(54) LIQUID DISCHARGE APPARATUS WITH PLATEN AND PLATEN MOVING DEVICE AND METHOD FOR CONTROLLING THE SAME

(75) Inventors: Yoichiro Shimizu, Kasugai (JP); Masahiro Nishizaki, Iwakura (JP); Yoshitsugu Morita, Nagoya (JP); Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 282 days.

(21) Appl. No.: 12/730,168

(22) Filed: Mar. 23, 2010

(65) Prior Publication Data

US 2010/0245418 A1 Sep. 30, 2010

(30) Foreign Application Priority Data

Mar. 31, 2009 (JP) ..... 2009-087433

(51) Int. Cl.
*B41J 29/38* (2006.01)

(52) U.S. Cl. ..... 347/9; 347/16; 347/104; 347/8

(58) Field of Classification Search ..... 347/4, 8, 347/9, 14, 16, 29, 32, 34, 105; 73/291, 293, 73/299, 302, 307, 312, 337; 137/393, 399
See application file for complete search history.

(56) References Cited

U.S. PATENT DOCUMENTS

| | | | | |
|---|---|---|---|---|
| 5,345,863 | A * | 9/1994 | Kurata et al. | 347/8 |
| 5,398,053 | A | 3/1995 | Hirosawa et al. | |
| 5,467,114 | A * | 11/1995 | Ebinuma et al. | 347/32 |
| 2004/0228669 | A1 | 11/2004 | Nakashima et al. | |

FOREIGN PATENT DOCUMENTS

| | | | |
|---|---|---|---|
| JP | S63-188073 | A | 8/1988 |
| JP | H02-276647 | A | 11/1990 |
| JP | H08-174805 | A | 7/1996 |
| JP | H09-024627 | A | 1/1997 |
| JP | 2002-361949 | A | 12/2002 |
| JP | 2003-170612 | A | 6/2003 |
| JP | 2004-142280 | A | 5/2004 |
| JP | 2004-262204 | A | 9/2004 |
| JP | 2005-028707 | A | 2/2005 |
| JP | 2005-280050 | A | 10/2005 |
| JP | 2006-142564 | A | 6/2006 |
| JP | 2010-234755 | A | 10/2010 |

OTHER PUBLICATIONS

Japan Patent Office, Notice of Reasons for Rejection for Japanese Patent Application No. 2009-087433 (counterpart to above-captioned patent application), mailed Feb. 8, 2011.

* cited by examiner

*Primary Examiner* — Juanita D Jackson
(74) *Attorney, Agent, or Firm* — Baker Botts L.L.P.

(57) ABSTRACT

A liquid discharge apparatus includes: a head having a nozzle surface having a plurality of nozzles which are open in the nozzle surface and through which a liquid is discharged toward an object; a transporting device which transports the object relative to the nozzle surface in a transporting direction and which positions the object to face the nozzle surface; a platen having a flexibility or bendability and provided with an attachment portion to which the object is attached; and a platen moving device which moves the platen in a direction orthogonal to the transporting direction to position the attachment portion at a nozzle facing position facing the nozzle surface under the condition that the liquid is discharged toward the object.

20 Claims, 16 Drawing Sheets

LIQUID DISCHARGE APPARATUS WITH PLATEN AND PLATEN MOVING DEVICE AND METHOD FOR CONTROLLING THE SAME

CROSS REFERENCE TO RELATED APPLICATION

The present application claims priority from Japanese Patent Application No. 2009-087433 filed on Mar. 31, 2009, the disclosure of which is incorporated herein by reference in its entirety.

BACKGROUND OF THE INVENTION

1. Field of the Invention

The present invention relates to a liquid discharge apparatus in which a platen is arranged at a position facing a nozzle surface of a liquid discharge head, and to a controlling method for controlling the liquid discharge apparatus.

2. Description of the Related Art

In a conventional technique, the platen is constructed to be movable and a driving device is attached to a body of the apparatus (casing, etc.); and upon performing the cleaning, the platen is moved by the driving device in a "transporting direction in which the paper or paper sheet is transported (paper-sheet transporting direction)", thereby retracting or withdrawing the platen from the position facing the nozzle surface. For example, there is proposed a construction in which the platen is divided into two portions, and the two divided portions are retracted or withdrawn to the upstream side and the downstream side, respectively, in the "paper-sheet transporting direction", or in which the two divided portions of the platen are pivoted or rotated in the "paper-sheet transporting direction".

According to the conventional technique, the platen can be temporarily retracted or withdrawn from the position facing the nozzle surface, and thus it is possible to avoid a situation that the platen obstructs the nozzle cleaning. However, the platen is divided into two portions, and the two divided portions are retracted to upstream and downstream sides, respectively, of the "paper transporting direction", which in turn makes it difficult to secure a retracting space for retracting the platen while avoiding interference with other part or component, thereby resulting in a problem such that the "freedom in designing the platen" is considerably limited. In the conventional technique, for example, rollers constructing a transporting device which transports the paper sheet are provided in the upstream and downstream sides of the transporting direction, as seen from the position facing the nozzle surface. Accordingly, in order to prevent the platen from interfering with the rollers, the platen has to be designed to have a narrow width (namely, length in the transporting direction); and thus there is a fear that the function for supporting the paper sheet might be compromised or lowered. Further, in the construction in which the two divided portions of the platen are rotatable or pivotable, it is necessary that the platen is arranged to be sufficiently away from the nozzle surface such that the platen is prevented from contacting with the nozzle surface; and thus there is a fear that the discharge characteristic might be lowered or lost.

SUMMARY OF THE INVENTION

The present invention has been made in order to solve the problems as described above, an object of which is to provide a liquid discharge apparatus in which a construction for retracting the platen can be designed more freely, without making the installation space for the liquid discharge apparatus be great, and to provide a controlling method for the liquid discharge apparatus.

According to a first aspect of the present teaching, there is provided a liquid discharge apparatus including: a head having a nozzle surface having a plurality of nozzles which are open in the nozzle surface and through which a liquid is discharged toward an object; a transporting device which transports the object relative to the nozzle surface in a transporting direction and which positions the object to face the nozzle surface; a platen having a flexibility or bendability and provided with an attachment portion to which the object is attached; and a platen moving device which moves the platen in a direction orthogonal to the transporting direction to position the attachment portion at a nozzle facing position facing the nozzle surface under the condition that the liquid is discharged toward the object.

According to a second aspect of the present teaching, there is provided a method for controlling a liquid discharge apparatus including a head having a nozzle surface having a plurality of nozzles which are open in the nozzle surface and through which a liquid is discharged toward an object; a transporting device which transports the object relative to the nozzle surface in a transporting direction and which positions the object to face the nozzle surface; a platen having a flexibility or bendability and provided with attachment portion to which the object is attached; a platen moving device which moves the platen in a direction orthogonal to the transporting direction to position the attachment portion at a nozzle facing position facing the nozzle surface under the condition that the liquid is discharged toward the object; and a platen lifting/lowering device which lifts and lowers the platen, the method including:

(a) transporting the object by the transporting device to a liquid discharge position facing the nozzle surface, and discharging the liquid toward the object through the nozzles of the head;

(b) moving the object, to which the liquid is adhered, out of the liquid discharging position by the transporting device;

(c) judging whether or not the liquid is to be discharged again with the head toward the object to which the liquid is adhered;

(d) transporting the object by the transporting device in a direction opposite to the transporting direction in the (a), under the condition that judgment is made to discharge the liquid again in the (c), and returning the object to the liquid discharging position by the transporting device;

(e) lifting the object upwardly by the platen lifting/lowering device and then shifting a position of the object by moving the platen with the platen moving device in the direction orthogonal to the transporting direction;

(f) transporting the object, of which position is shifted in the (e), by the transporting device further to a starting position of the (a); and (g) transporting the object by the transporting device to a direction which is same as the transporting direction in the (a), and discharging the liquid again toward the object through a nozzle, among the plurality of nozzles, of the head.

BRIEF DESCRIPTION OF THE DRAWINGS

FIGS. 5A and 5B are perspective view each showing constructions of the platen and platen driving device, wherein FIG. 5A is a perspective view showing a state that the platen is positioned at a supporting position, and FIG. 5B is a perspective view showing a state that the platen is positioned at a platen retracting position.

FIGS. 8A to 8C are views showing an operation aspect of the ink discharge apparatus according to the first embodiment, wherein FIG. 8A is a front view showing a "print position", FIG. 8B is a front view showing a "cap position", and FIG. 8C is a front view showing a "paper-sheet moving position".

FIGS. 11A and 11B are views each showing main parts or components of an ink discharge apparatus according to a second embodiment, wherein FIG. 11A is a side view and FIG. 11B is a plan view.

FIGS. 12A to 12C are views showing an operation aspect of the ink discharge apparatus according to the second embodiment, wherein FIG. 12A is a front view showing a "print position", FIG. 12B is a front view showing a "paper-sheet moving position", and FIG. 12C is a front view showing a "platen retracting position".

FIGS. 14A and 14B are perspective view each showing constructions of a platen and a platen driving device in an ink discharge apparatus according to a third embodiment, wherein FIG. 14A is a perspective view showing a state that the platen is positioned at a supporting position, and FIG. 14B is a perspective view showing a state that the platen is positioned at a platen retracting position.

FIGS. 15A to 15C are perspective view each showing constructions of a platen and a platen driving device in an ink discharge apparatus according to a fourth embodiment, wherein FIG. 15A is a perspective view showing a state that a first platen is positioned at a supporting position, FIG. 15B is a perspective view showing a state that a second platen is positioned at the supporting position, and FIG. 15C is a perspective view showing a state that the first platen and the second platen are positioned at a first platen retracting position and a second platen retracting position, respectively.

DESCRIPTION OF THE PREFERRED EMBODIMENTS

In the following, a "liquid discharge apparatus" and a "controlling method for liquid discharge apparatus" according to preferred embodiments of the present teaching will be explained with reference to the drawings. Note that although the present teaching is applied to an "ink discharge apparatus" in the following embodiments, the present teaching is applicable also to other "liquid discharge apparatus" such as a "coloring-liquid discharge apparatus" which discharges a coloring liquid, a "conductive-liquid discharge apparatus" which discharges a conductive liquid, etc. In a case that the present teaching is applied to the "coloring-liquid discharge apparatus", the "conductive-liquid discharge apparatus", or the like, it is assumed that a term "ink" used in the following explanation is exchangeably read as "coloring liquid", "conductive liquid", or the like. Further, in the following explanation, a term "down (downward)" is intended to mean a direction in which the ink is discharged (ink-discharging direction) and a term "up (upward)" is intended to mean an opposite direction to the direction intended by the term "down" or the ink-discharging direction.

First Embodiment

Figure 1:
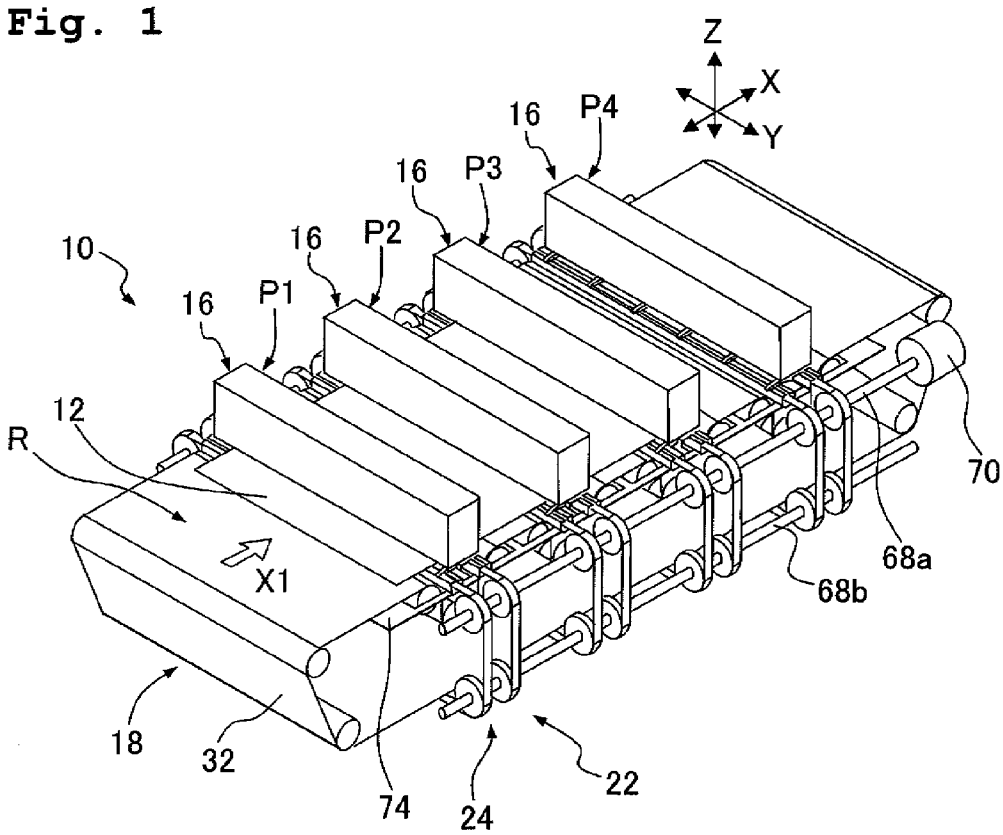
FIG. 1 is a perspective view showing a construction of an ink discharge apparatus according to a first embodiment.
Figure 2:
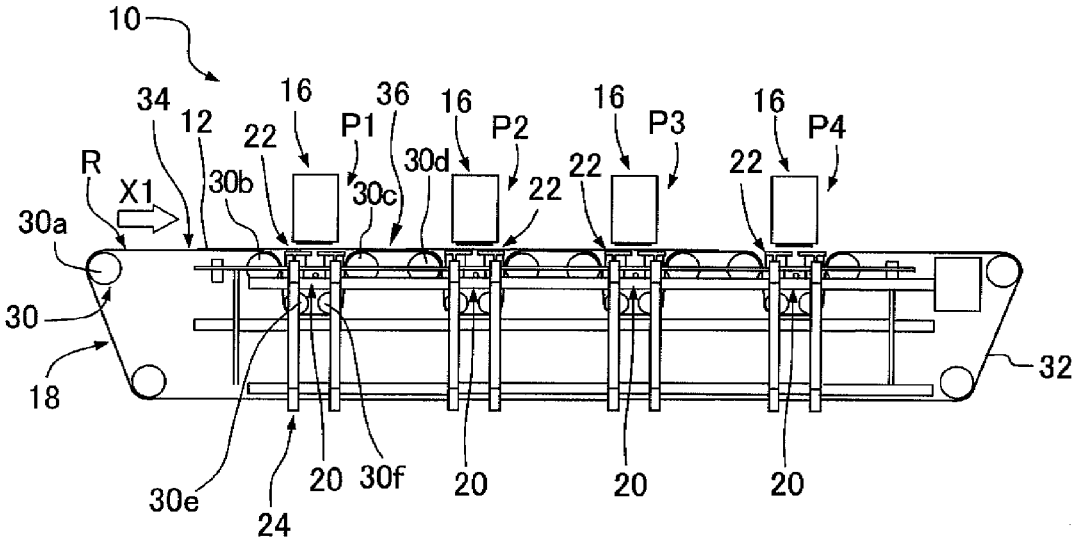
FIG. 2 is a front view showing the construction of the ink discharge apparatus according to the first embodiment.

As shown in FIGS. 1 and 2, an ink discharge apparatus 10 is provided with a plurality of pieces of (four in the embodiment) ink-discharge line head 16 as the "liquid discharge head (head)" having a plurality of nozzles 14 (FIG. 4) through which an ink is discharged toward a paper sheet 12 as the "discharge-objective (object)"; a transporting device 18 which transports the paper sheet 12 to the ink-discharge line heads 16; a platen 22 (FIG. 2) which supports the paper sheet 12 at a position facing the plurality of nozzles 14; and a platen driving device (platen moving device) 24 which drives (moves) the platen 22. Further, the ink discharge apparatus 10 of the embodiment is provided with a cap device 20 (FIG. 2) which covers the plurality of nozzles 14 as necessary. In this embodiment, as shown in FIGS. 1 and 2, a transporting route R for transporting the paper sheet 12 is formed or defined by the transporting device 18; and in the transporting route R, four pieces of the ink-discharge line head 16 which discharge four color inks of black (BK), yellow (Y), cyan (C) and magenta (M) respectively are fixedly arranged at head positions P1 to P4, respectively, each of the head positions P1 to P4 being located an intermediate portion of the transporting route R. Further, the cap device 20, the platen 22 and the platen driving device 24 are arranged corresponding to each of the ink-discharge line heads 16.

Note that the number of the ink-discharge line heads 16 is not particularly limited, and it is allowable that only one piece of the ink-discharge line head 16 having a function to discharge one color ink or a plurality of color inks is arranged. In the following explanation, a transporting direction of the paper sheet 12 is referred to as a "transporting direction X", an orthogonal direction orthogonal to the transporting direction X is referred to as a "line direction Y", and a perpendicular direction perpendicular to the "transporting direction X" and the "line direction Y" is referred to as a "height direction Z".

<Transporting Device>

As shown in FIGS. 1 and 2, the transporting device 18 feeds or supplies the paper sheet 12 to an "ink discharging position E" (FIG. 8A) located corresponding to each of the head positions P1 to P4, and moves or discharges the paper sheet 12 out of or from the "ink discharging position E"; and the transporting device 18 has a roller unit 30 constructed of a plurality of rollers (20 rollers in the embodiment, including rollers 30*a* to 30*f* which will be described later), a transporting belt 32 wound around the plurality of rollers of the roller unit 30, and a driving motor (not shown) connected to at least one of the rollers. An operation in which the transporting device 18 supplies or feeds the paper sheet 12 to the "ink discharging position E" and then moves the paper sheet 12 from or feed the paper sheet 12 out of the "ink discharging position E" is referred to as a "normal transporting operation"

or a "regular feeding operation" of which transporting direction is referred to as a "normal transporting direction" as indicated with an arrow X1 in FIGS. 1 and 2, and FIGS. 10A and 10B. On the other hand, the transporting device 12 is capable of transporting the paper sheet 12 in a reverse or opposite direction reverse or opposite to the "normal transporting direction" by, for example, reversely rotating the driving motor (not shown); such operation is referred to as a "reverse transporting operation" of which transporting direction is referred to as a "reverse transporting direction" as indicated with an arrow X2 in FIG. 10C.

As shown in FIG. 2, at a portion of the transporting device 18 which corresponds to the head position P1, a paper-sheet supplying portion 34 which supplies the paper sheet 12 to the "ink discharging position E" (FIG. 8A) is constructed of two rollers 30*a* and 30*b* arranged at the upstream side of the "ink discharging position E" in the normal transporting direction X1, and the transporting belt 32 wound around or allowed to travel along the rollers 30*a* and 30*b*. Further, a paper-sheet moving portion (paper-sheet discharging portion) 36 which moves or discharges the paper sheet 12 out of or from the "ink discharging position E" is constructed of two rollers 30*c* and 30*d* arranged at the downstream side of the "ink discharging position E" in the normal transporting direction X1, and the transporting belt 32 wound around or allowed to travel along the rollers 30*c* and 30*d*. Furthermore, two rollers 30*e* and 30*f* which make the transporting belt 32 move or escape from the transporting route R downwardly are arranged between the rollers 30*b* and 30*c* which are located at the upstream and downstream sides, respectively, in the normal transporting direction X1 of the "ink discharging position E", the rollers 30*e* and 30*f* being located at a position below or under the rollers 30*b* and 30*c*, thereby securing a substantially U-shaped space in which the cap device 20 is arranged at a position below or under the "ink discharging position E", and securing a cap moving route S (FIG. 8A) along which the nozzle cap 50 is moved into the inside of the substantially U-shaped space as will be described later on.

Note that three portions, in the transporting device 18, corresponding to the head positions P2 to P4 are each also constructed in a same manner as regarding the portion corresponding to the head position P1.

<Liquid-Discharge Line Head>

As shown in FIGS. 1 and 2, the ink-discharge line head 16 is fixedly arranged at each of the head positions P1 to P4 and extends in the orthogonal direction orthogonal to the transporting direction X (namely, the line direction Y). The ink-discharge line head 16 discharges the ink toward the paper sheet 12 supplied from the paper-sheet supplying portion 34 to the "ink discharging position E" (FIG. 8A), and has a head holder 40 and a nozzle plate 42 as shown in FIG. 4.

Figure 4:
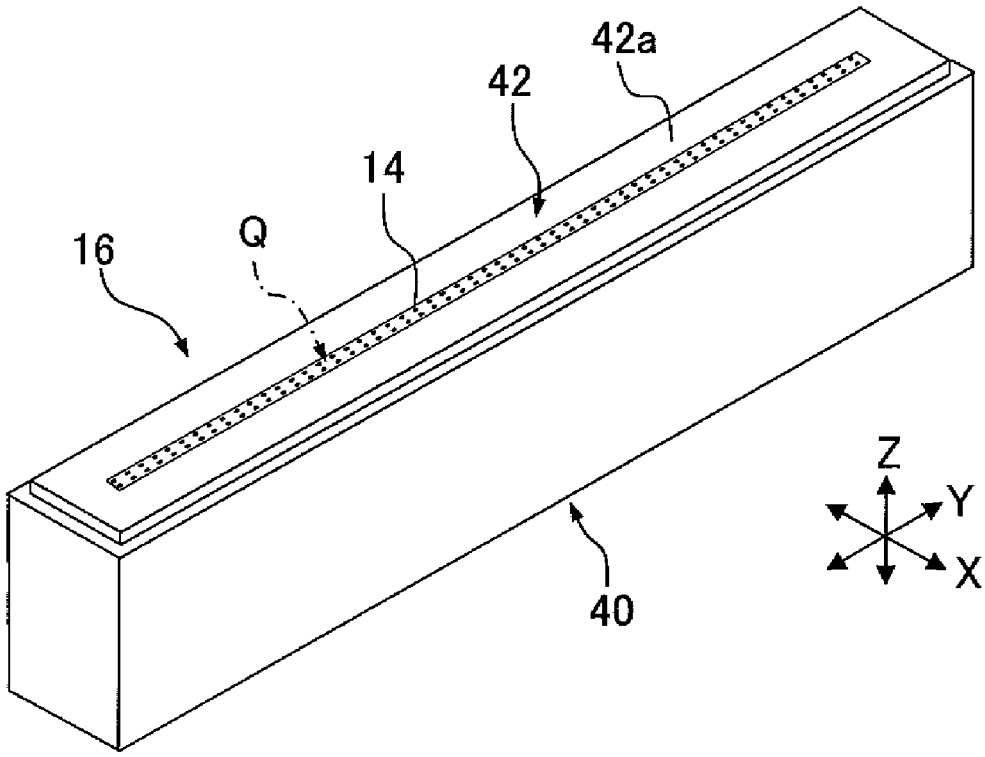
FIG. 4 is a perspective view showing a construction of the ink-discharge line head, as seen from the side of bottom surface of the ink-discharge line head.

As shown in FIG. 4, the head holder 40 is constructed to have a substantially rectangular parallelepiped shape extending in the line direction Y, and the nozzle plate 42 is arranged on the bottom surface of the head holder 40. The nozzle plate 42 has a nozzle surface 42*a* having the plurality of nozzles 14 thorough which the ink is discharged and which are open in the nozzle surface 42*a*. In the nozzle plate 42, the length of an area (hereinafter referred to as "nozzle area") Q in which the nozzles 14 are formed in the nozzle surface 42*a* is designed to be longer than the width of the paper sheet 12 such that the nozzles 14 correspond across one end and the other end in the width direction (the length in the line direction Y) of the paper sheet 12. On the other hand, the width of the nozzle area Q (namely, the length in the transporting direction X) is not particularly limited. In the embodiment, however, the width of the nozzle area Q is designed to be sufficiently narrower than the width of the nozzle surface 42*a* such that the nozzle area Q is located in the nozzle surface 42*a* at a central portion thereof in the transporting direction X.

Although not shown, a flow channel unit having a plurality of pressure chambers individually communicating with the nozzles 14 respectively, an actuator having a plurality of driving portions individually corresponding to the pressure chambers respectively, and a circuit board which applies driving voltage to each of the driving portions of the actuator are integrally adhered to the upper surface of the nozzle plate 42, and the above-described constituent parts or components are accommodated inside the head holder 40. Further, the circuit board is drawn from the head holder 40 and is connected to a controller (not shown), and the driving voltage is applied to the actuator based on a control signal outputted from the controller. Furthermore, an ink tank which is arranged at the outside of the head holder 40 is connected to the flow channel unit via an ink tube, and an ink fed out from the ink tank is supplied to the flow channel unit. Note that the system for discharging the ink through or from the nozzles 14 is not particularly limited, and it is allowable to adopt a system in which the ink is discharged by using a "pressure generated when being heated by a heating element", instead of adopting the system in which the ink is discharged by using the "actuator".

<Cap Device>

Figure 3:
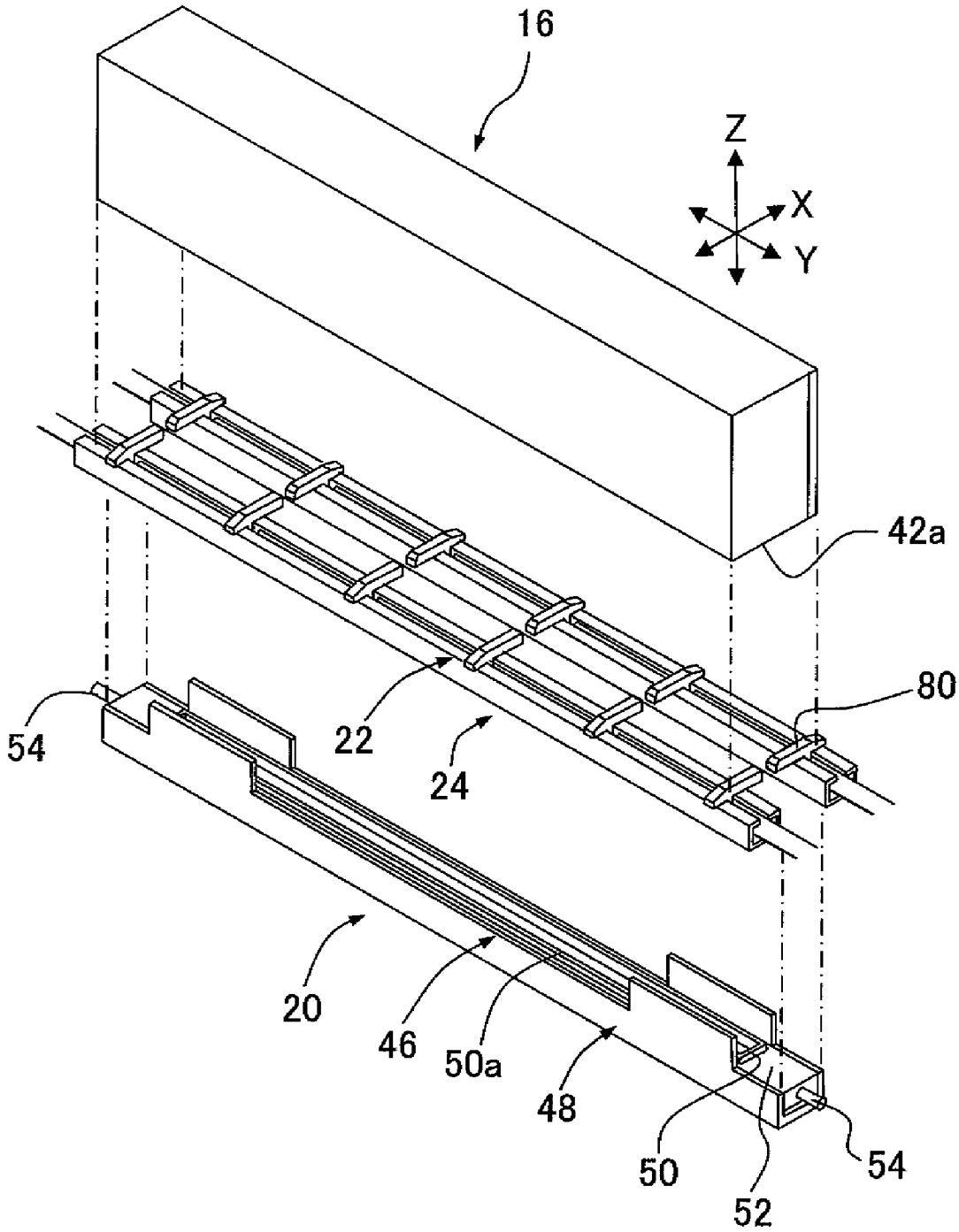
FIG. 3 is an exploded perspective view showing a positional relationship among an ink-discharge line head, a cap device and a platen with one another.

As shown in FIG. 3, the cap device 20 has a cap unit 46, and a cap guide 48 which guides the cap unit 46 when the cap unit 46 is moved in a up and down direction (namely, in a direction moving closer to and away from the nozzle surface 42*a*).

The cap unit 46 has a nozzle cap 50, and a cap holder 52 which supports the nozzle cap 50, and the nozzle cap 50 is positioned to face or be opposite to the nozzle surface 42*a* (FIG. 4) of the ink-discharge line head 16. The cap unit 46 is accommodated inside the cap guide 48. The basic function of the nozzle cap 50 is to cover the nozzles 14 by being brought into contact with the nozzle surface 42*a*; and an end 50*a*, of the nozzle cap 50, on the side at which the nozzle cap 50 is open is formed of a material having a shock-absorbing or cushioning material such as rubber, so as not to damage the nozzle surface 42*a* (FIG. 4). Further, the end 50*a* has a substantially elongated rectangular shape in a plan view which extends in the line direction Y such that the nozzle area Q (FIG. 4) can be covered therewith. Furthermore, the nozzle cap 50 has a suction mechanism (device) (not shown) which sucks the ink forcibly, etc. Action portions 54 having a protruding shape are formed in the cap holder 52 at both end surfaces in the line direction Y, and it is constructed such that a driving force from a cam (not shown) is transmitted to the action portions 54. When the driving force of the cam is imparted to the action portions 54, the nozzle cap 50 is moved, together with the cap unit 46, in the up and down direction along the cap moving route S (FIG. 8A), thereby making the nozzle cap 50 be moved between a "cap attaching position F1" (FIG. 8B) at which the nozzle cap 50 is brought into contact with the nozzle surface 42*a* to cover the nozzles 14 and a "cap retracing position F2" (FIG. 8C) at which the nozzle cap 50 is away from the nozzle surface 42*a*.

<Platen>

Figure 5A:
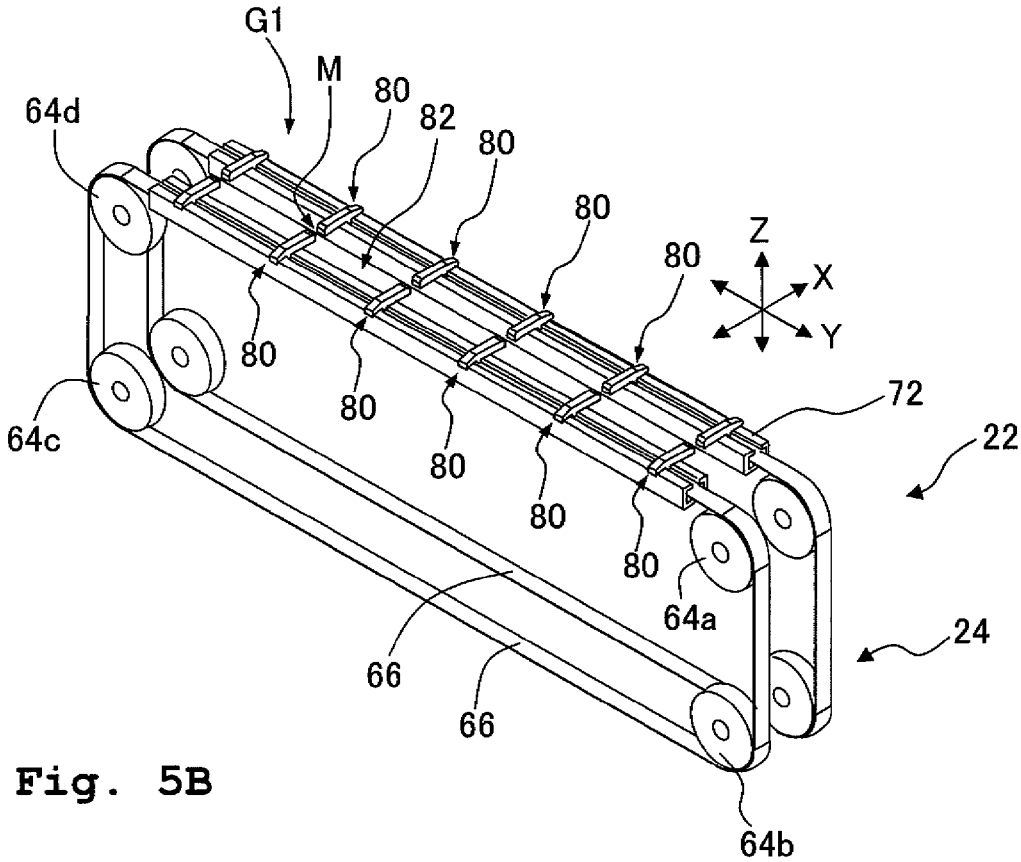
Figure 8A:
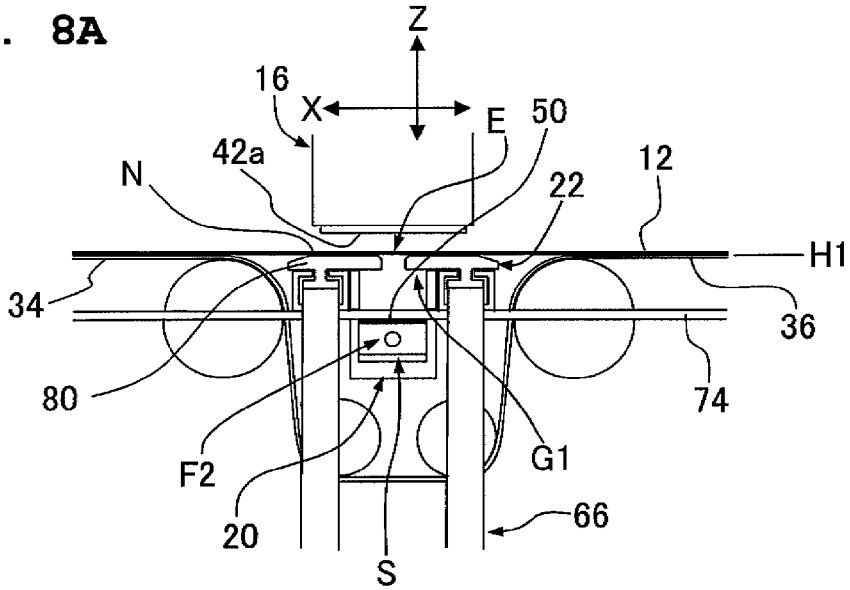

As shown in FIG. 8A, the platen 22 supports the paper sheet 12, which is positioned at the "ink discharging position E", at the "supporting position G1 (nozzle facing position)" facing the nozzle surface 42*a*. As shown in FIG. 5A, the platen 22 is constructed of a platen belt 66 having flexibility or bendability, an attachment portion (a placement portion) 80 provided as 6 pieces of attachment portions 80 which are formed for the platen belt 66. In the embodiment, two pieces of the platen 22 are provided for each of the head positions P1 to P4 (FIG. 1) corresponding thereto. The platen belt 66 of the embodiment is an endless belt, and is wound around four platen belt pulleys 64*a* to 64*d* of the platen driving device 24 (which will be described later on). Since the platen 22 includes the platen belt 66 having the flexibility or bendability, the platen 22, as a whole, has the flexibility or bendability. The attachment portions 80 of the embodiment are all formed to have identical shapes, and 6 pieces of the attachment portions 80 which are formed for each of the two platen belts 66, are formed with a certain spacing distance in the line direction Y. Further, 6 pieces of the attachment portions 80 formed in one of the platen belts 66 and 6 pieces of the attachment portions 80 formed in the other of the platen belts 66 are arranged to face one another and with a gap M in the transporting direction X. The gap M defines an opening 82, continuously in the line direction Y, via which the ink discharged from the nozzles 14 (FIG. 4) is released or escaped to the side opposite to the side of the nozzles 14 during a so-called "borderless printing" and a "preliminary discharge" which is performed right before performing printing for the paper sheet 12. Note that the term "preliminary discharge" is not limited only to that in which the ink is discharged from the nozzles 14 right before the printing for the paper sheet 12, and may be such an operation in which only the ink is discharged without any transportation of the paper sheet 12. In the following, a specific construction of the attachment portions 80 will be explained.

Figure 7:
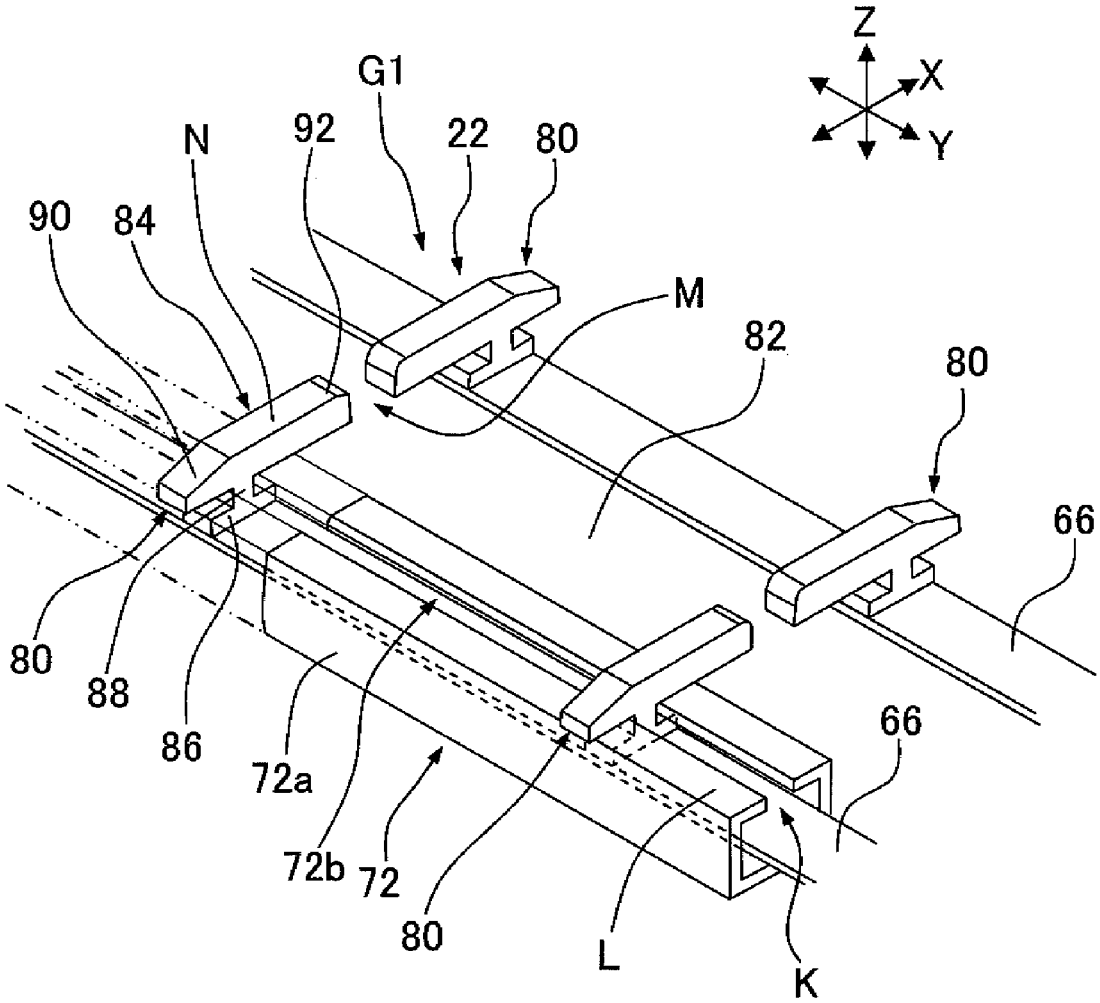
FIG. 7 is a partially-enlarged perspective view showing the construction of the platen.
Figure 10A:
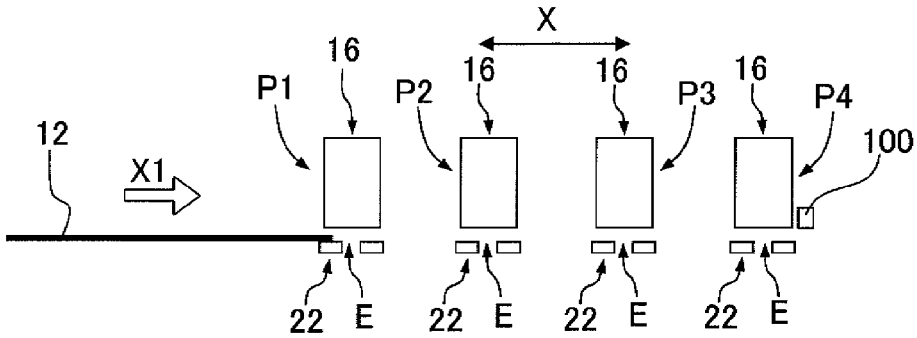
FIGS. 10A to 10C are flow drawings showing the steps of the controlling method for the ink discharge apparatus, in a stepwise manner.

As shown in FIG. 7, the attachment portions 80 formed on one of the platen belts 66 each have a body portion 84 which is supported on a platen supporting surface L (to be described later on) of the platen supporting member 72, a fix portion 86 which is fixed to the platen belt 66, and a connection portion 88 connecting the body portion 84 and the fix portion 86. The body portion 84 is formed to have a substantially bar shape extending in the transporting direction X, and the upper surface of the body portion 84 is formed to be a flat surface which is parallel to the nozzle surface 42*a* at the "supporting position G1" (FIG. 8A). This upper surface of the body portion 84 is a "paper-sheet placing surface N (paper-sheet attaching surface N)" on which the paper sheet 12 is placed or attached. Further, a guide surface 90 is formed in the body portion 84 at an end portion located on the side opposite to the gap M, and the guide surface 90 is inclined closely toward the nozzle surface 42*a* (FIG. 8A) as approaching toward the side of the gap M. Furthermore, a guide surface 92 is formed in the body portion 84 at an end portion located on the side of the gap M, and the guide surface 92 is inclined away from the nozzle surface 42*a* (FIG. 8) as approaching toward the side of the gap M. Accordingly, upon performing a transporting operation during which the guide surface 90 is located at the upstream side, an edge or end portion of the paper sheet 12 can be guided with the guide surface 90; and upon performing a transporting operation during which the guide surface 92 is located at the upstream side, an edge or end portion of the paper sheet 12 which passes across the gap M can be guided with the guide surface 92. Accordingly, in any of the normal transporting operation (regular feeding operation; FIG. 10A) and the reverse transporting operation (FIG. 10C), it is possible to prevent the paper sheet 12 from being caught with respect to the platen 22.

The fix portion 86 is a part which is firmly joined with respect to the platen belt 66 by using a joining material such as adhesive, fixation screw, etc. As shown in FIG. 7, a length, of the fix portion 86, in the transporting direction X is designed to be approximately same as the width of the platen belt 66, and a length, of the fix portion 86, in the line direction Y is designed with consideration for example of the curvature of the platen belt pulleys 64*a* to 64*d* (FIG. 6) at the outer surface thereof, such that the platen belt 66 can smoothly run or travel along the platen belt pulleys 64*a* to 64*d*, as will be described later on. The connection portion 88 is a part which connects the body portion 84 and the fix portion 86 without losing or compromising the functions of the body portion 84 and the fix portion 86. As shown in FIG. 7, a length, of the connection portion 88, in the transporting direction X is designed to be smaller than the width of the slit 72*b* in the platen supporting member 72 which will be described later on, and a length, of the connection portion 88, in the up and down direction is designed to be sufficiently longer than the thickness of a portion of the platen supporting member 72 at which the slit 72*b* is formed.

The attachment portions 80 formed for the other of the platen belts 66 are arranged or oriented in an opposite direction with respect to the attachment portions 80 formed for one of the platen belts 66. The platen 22 is constructed, as a whole, to be symmetrical on the both sides in the transporting direction X with the gap M intervened therebetween. Accordingly, in any case of performing the normal transporting operation (regular feeding operation; FIG. 10A) and the reverse transporting operation which will be described later on (FIG. 10C), it is possible to effectively prevent the paper sheet 12 from being caught by the platen 22 and possible to support the paper sheet 12 in assured manner. Note that the platen belt 66 and the attachment portions 80 may be formed at the same time by integrated formation, rather than by joining separate members.

Further, the ink discharge apparatus 10 of the embodiment has a platen supporting member 72. The platen supporting member 72 supports the platen 22 at the position corresponding to the "supporting position G1" as shown in FIGS. 5A and 7. As shown in FIG. 7, the platen supporting member 72 has a groove-shaped construction including a body portion 72*a* which is a pipe-shaped member having a substantially rectangular cross section and which extends in the line direction Y, and a slit 72*b* which extends in the line direction Y and which is formed in the upper surface of the body portion 72*a*. An internal space in the body portion 72*a* defines a "belt accommodating space K" which accommodates the platen belt 66, and the upper surface of the body portion 72*a* is a "platen supporting surface L" which supports the platen 22. The length of the platen supporting member 72 is designed to have a substantially same length as or a longer than the width of the paper sheet 12 such that the platen 22, supporting the paper sheet 12, can be supported by the platen supporting member 72 in assured manner. Although the platen 22 has the flexibility or bendability, the platen 22 can assuredly support the paper sheet 12 since the platen 22 is supported by the platen supporting member 72 at the supporting position G1. Note that also in the embodiment, the platen supporting member 72 has the groove-shaped construction capable of accommodating the platen belt 66 therein, the groove-shaped structure is not indispensable; it is enough that the platen supporting member 72 has a plate-shaped member supporting the platen.

<Platen Driving Device>

Figure 5B:
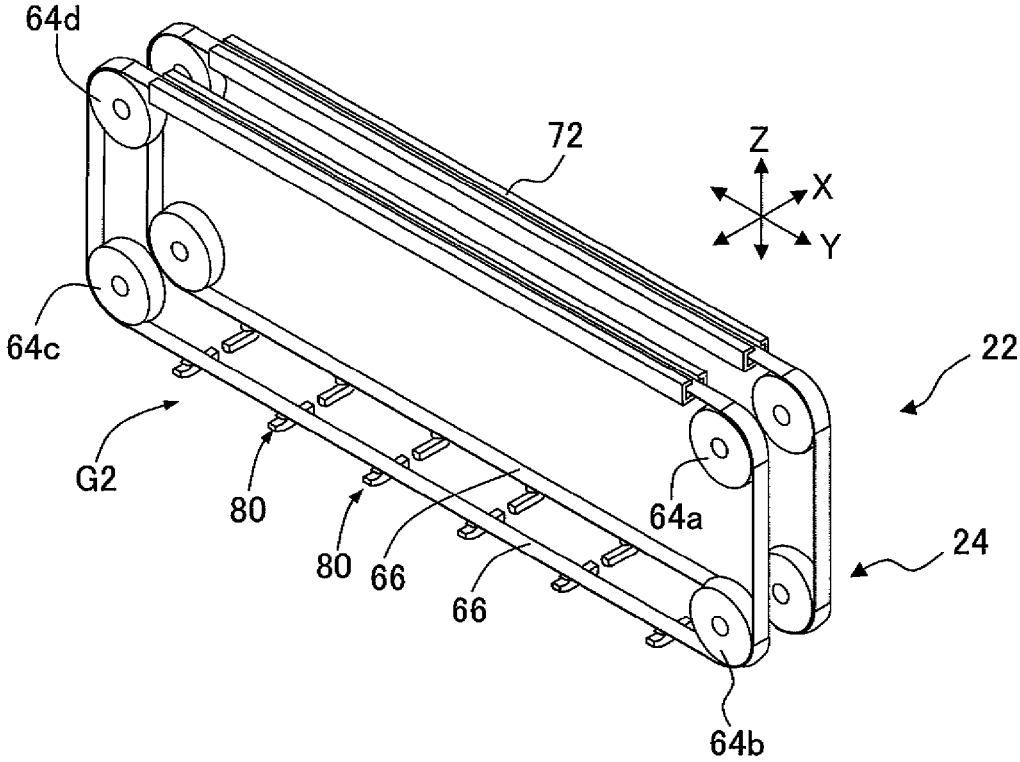

As shown in FIGS. 5A and 5B, the platen driving device (platen moving device) 24 moves the platen 22 in the orthogonal direction orthogonal to the transporting direction X to position the attachment portions 80 to face or opposite to the nozzle surface 42*a*. Further, the platen driving device 24 drives (moves) the platen 22 and makes the attachment portions 80 of the platen 22 move from the "supporting position G1" in the parallel direction parallel to the nozzle surface 42*a*

(FIG. 4) and in the orthogonal direction orthogonal to the transporting direction X (namely, the line direction Y). Subsequently, the platen driving device 24 retracts the attachment portions 80 to the "platen retracting position (attachment portion retracting position) G2" (FIG. 5B) located out of (outside of) or different from the cap moving route S (FIG. 8A) along which the nozzle cap 50 is moved.

Figure 6:
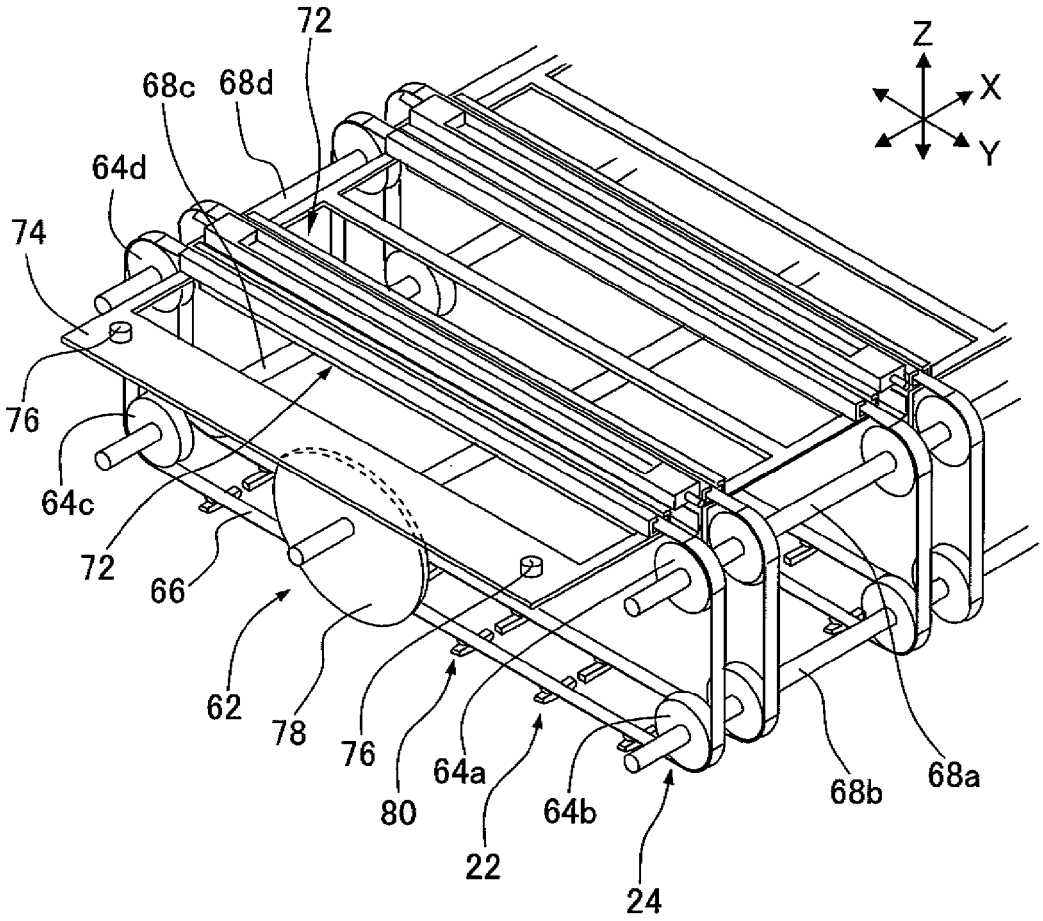
FIG. 6 is a perspective view showing the construction of the platen driving device.

In the embodiment, as shown in FIG. 6, the platen driving device 24 has four platen belt pulleys 64*a* to 64*d*, four shafts 68*a* to 68*d*, and a driving motor 70 (FIG. 1) connected to any one of the four shafts 68*a* to 68*d* (the shaft 68*a* in the embodiment); and the four platen belt pulleys 64*a* to 64*d* are attached to the four shafts 68*a* to 68*d*, respectively. The platen belt 66 is wound around the platen belt pulleys 64*a* to 64*d*; in the embodiment, the platen 22 is formed integrally with the platen driving device 24. Accordingly, when the shaft 68*a* is rotated by the driving motor 70 (FIG. 1), the rotational force of the shaft 68*a* is transmitted to the platen belt 66, and a portion of the platen belt 66 at which the attachment portions 80 are formed is guided by the platen belt pulleys 64*a* to 64*d* and thus moves between a position corresponding to the "supporting position G1" and a position corresponding to the "platen retracting position G2". Namely, the platen belts 66 of the platen 22 are rotationally driven (rotationally moved) by the platen driving device 24, and a result of this, the attachment portions 80 are moved. Note that since two pieces of the platen 22 are provided for each of the head positions P1 to P4 (FIG. 1) in this embodiment, two pieces of the platen driving device 24 are also provided for each of the head positions P1 to P4 (ink-discharge line heads 16), corresponding to this.

<Platen Lifting/Lowering Device>

A platen lifting/lowering device 62 is a device which changes a position of the platen 22 in the height direction Z. As shown in FIGS. 8 and 12, the platen lifting/lowering device 62 changes the position of the platen 22 in the height direction Z to a "first height H1", a "second height H2" and a "third height H3" which will be described later on. In the embodiment, as shown in FIG. 6, the platen lifting/lowering device 62 has a platen guide plate 74 which is provided commonly for the respective head positions P1 to P4 (FIG. 1), a guide shaft 76 which guides the platen guide plate 74 in the up and down direction, a cam 78 which is brought into contact with the lower surface of the platen guide plate 74 and which lifts and lowers (moves upwardly and downwardly) the platen guide plate 74, and a driving motor (not shown) which rotates the cam 78. The platen supporting member 72 is placed on the upper surface of the platen guide plate 74. Therefore, when the platen guide plate 74 is moved in the up and down direction by the cam 78, the platen supporting member 72 is moved in the up and down direction, and the height of the platen 22 is changed or varied accompanying therewith.

[Operation of the Ink Discharge Apparatus According to the First Embodiment]

Figure 8B:
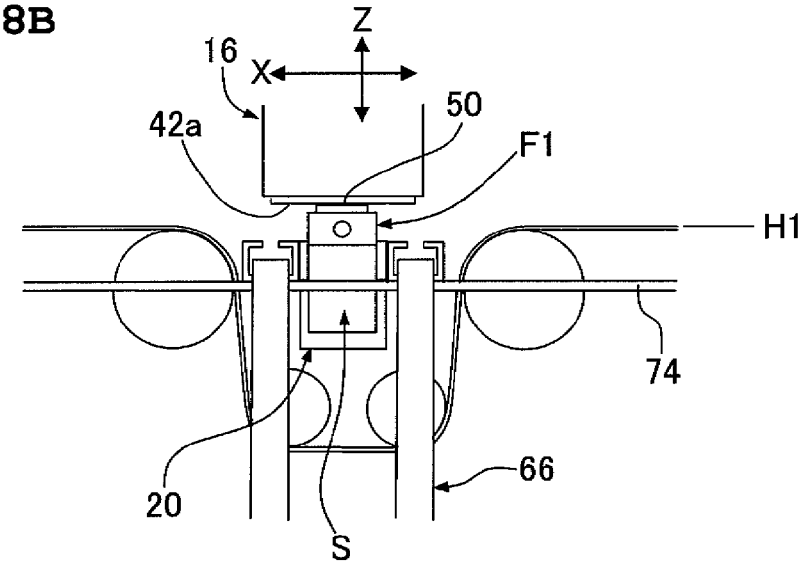

An operation of the ink discharge apparatus 10 will be explained with reference to FIGS. 8A to 8C.

<Print Position>

Upon performing printing operation by using the ink discharge apparatus 10, the "print position" shown in FIG. 8A is selected. The "print position" is an aspect in which the platen 22 is supported at the "supporting position G1" and the nozzle cap 50 is supported at the "cap retracing position F2". Note that the term "supporting position G1" means a position at which the paper sheet 12 can be supported, and at which the "paper-sheet placing surface N" (FIG. 7) in the platen 22 is at a height (hereinafter referred to as "first height H1") same as the upper surface of the paper-sheet supplying portion 34 and the upper surface of the paper-sheet moving portion (paper-sheet discharging portion) 36 in the transporting device 18.

When the paper sheet 12 is supplied to the "ink discharging positions E" corresponding to the head positions P1 to P4 respectively, then the paper sheet 12 is supported by the platen 22 positioned at the "supporting position G1" and the ink is discharged toward the paper sheet 12 from the nozzles 14 of each of the ink-discharge line heads 16. In this embodiment, since the ink can be released in the downward direction from the opening 82 (FIG. 5A) defined by the two platens 22 therebetween, it is possible to adapt also to the so-called "borderless printing". Further, since the opening 82 is formed to extend in the longitudinal direction of the platen 22, it is possible to perform the "borderless printing" for the paper sheet 12 of various sizes. Upon performing the "preliminary discharge" in order to maintain or restore the performance or function of the nozzles 14, the ink which becomes viscous, the ink into which air bubbles are mixed, etc. is/are discharged from the nozzles 14. However, it is possible to discharge such ink(s) from the opening 82 in the downward direction. The ink, released from the opening 82 in the downward direction, can be recovered by the nozzle cap 50.

<Cap Position>

Upon stopping the printing operation and covering the nozzle area Q (FIG. 4) with the nozzle cap 50, the "cap position" shown in FIG. 5B is selected. The "cap position" is selected when the printing operation is not performed and in, for example, a "cleaning operation" wherein the ink which becomes viscous, the ink into which air bubbles are mixed, etc. in the nozzles 14 is/are sucked and removed with a suction mechanism (not shown), or in a "maintenance operation" in which the nozzle surface is subjected to capping (is capped) for preventing the ink in the nozzles 14 from becoming viscous and firmly adhered due to natural evaporation. The term "cap position" means an aspect in which the platen 22 is supported at the "platen retracting position G2" (FIG. 5B) and the nozzle cap 50 is supported at the "cap attaching position F1".

Upon performing transition from the "print position" to the "cap position", the platen driving device 24 is driven so that the attachment portions 80 of the platen 22 are moved from the "support position G1" in the parallel direction parallel to the nozzle surface 42*a* and in the orthogonal direction orthogonal to the transporting direction X (namely in the line direction Y), then the platen 22 is transported by the platen belt pulleys 64*a* and 64*b* (FIG. 5A) while the platen 22 is bent in two stages, and then the platen 22 is folded back by 180 degrees and is retracted to the "platen retracting position G2" (FIG. 5B). Substantially concurrently with this retracting operation, the cap unit 46 is lifted upward by the cam, and the nozzle cap 50 is moved from the "cap retracing position F2" (FIG. 8A) to the "cap attaching position F1" (FIG. 8B). At this time, the cap moving route S (FIG. 8A) along which the nozzle cap 50 is moved, is open by retracting the attachment portions 80 of the platen 22, and thus it is possible to prevent the nozzle cap 50 from colliding with the attachment portions 80 of the platen 22.

By such an operation, the nozzle cap 50 is brought into contact with the nozzle surface 42*a* and the viscous ink, etc. can be removed (discharged) from inside the nozzles 14 by generating negative pressure in the nozzle cap 50 with the suction mechanism (not shown). Further, by capping the nozzle surface 42*a*, it is also possible to satisfactorily maintain the state of the nozzles 14, until next print instruction is received. Furthermore, since the attachment portions 80 of the platen 22 (the portion of the platen 22 at which the attachment portions 80 are formed) is folded back by 180 degrees and is made to retract to the platen retracting position G2 (FIG. 5B) located under or below the transporting route R (FIG. 1), it is possible to prevent the attachment portions 80 of the platen 22, which are located at the platen retracing position G2, from greatly protruding to the outside of the transporting route R, thereby making it possible to avoid the entire apparatus from becoming large-sized.

In this embodiment, since the attachment portions 80 of the platen 22 are moved in the orthogonal direction orthogonal to the transporting direction X of the paper sheet 12 (the line direction Y), the retracting space for retracting the attachment portions 80 can be easily secured at a position away from the nozzle surface 42*a* of the ink-discharge line head 16. Further, it is possible to guide the attachment portions 80 of the platen 22 to the platen-retracting position while bending the attachment portions 80 of the platen 22 (the portion of the platen 22 at which the attachment portions 80 are formed) in the shifting direction shifted from the parallel direction parallel to the nozzle surface 42*a* (in a direction which is not parallel to the nozzle surface 42*a*). Therefore, by appropriately selecting a bending angle for the bending, it is possible to prevent the platen 22 from greatly protruding to the outside of the transporting route along which the paper sheet 12 is transported. Since the attachment portions 80 is pulled from the supporting position G1 in the parallel direction parallel to the nozzle surface 42*a* and then the attachment portions 80 is moved in an opposite direction to the parallel direction (the platen 22 is folded by 180 degrees) and is guided to the platen retracting position G2, it is possible to design such that the supporting position G1 and the platen retracting position G2 are overlapped in the up and down direction, thereby making it possible to make the entire ink discharge apparatus 10 to be compact-sized or small-sized.

<Paper-Sheet Moving Position>

The "paper-sheet moving position" means an operation aspect used in a step of "shifting the position of the paper sheet 12 in the line direction Y" (Step S13 in FIG. 9) in a "controlling method for the ink discharge apparatus" which will be described later. As shown in FIG. 8C, the "paper-sheet moving position" is an aspect wherein the attachment portions 80 of the platen 22 are supported at a "second height H2" which is closer to the nozzle surface 42*a* than the "first height H1" at which the "support position G1" (FIG. 8A) exists, and wherein the nozzle cap 50 is supported at the "cap retracting position F2". Upon performing transition from the "print position" to the "paper-sheet moving position", the platen lifting/lowering device 62 (FIG. 6) is driven to thereby lift the platen 22, in the height direction Z, from the "first height H1" to the "second height H2".

<Controlling Method for the Ink Discharge Apparatus>

A controlling method for the ink discharge apparatus 10 will be explained with reference to FIGS. 9 and 10. Note that in FIGS. 9 and 10, the cleaning step, etc. relating to the operation of the nozzle cap 50 are omitted.

For example, in a case that the viscous ink, air bubbles or/and foreign matter inside the nozzle 14 is/are not removed even with the "cleaning operation", in a case that the viscous ink or/and paper powder (paper dust) after the wiping enters/enter reversely into the nozzle 14, and/or in a case that the ink discharge function of at least one nozzle 14 among the plurality of nozzles 14 is lost due to electric inconvenience or malfunction, etc., then a so-called phenomenon of "pin-lack (dot-lack or print-lack)" in which the ink is not discharged on the surface of the paper sheet 12 at a position in the image formed on the surface of the paper sheet 12, the position corresponding to the at least one nozzle 14. In the embodiment, however, it is possible to solve the problem of "pin-lack" by shifting the position of the paper sheet 12 in the line direction Y and then performing the printing operation again (performing re-printing operation). Namely, the embodiment is configured by arranging a pin-lack detector 100 on the downstream side, in the normal transporting direction X1, of the "ink discharging position E" which corresponds to the head position P4, such that the "re-printing operation" can be performed by the controller (not shown), based on the output of the pin-lack detector 100. In the following, an explanation will be given regarding a "controlling method for ink discharge apparatus" including the control of the "re-printing operation".

Figure 9:
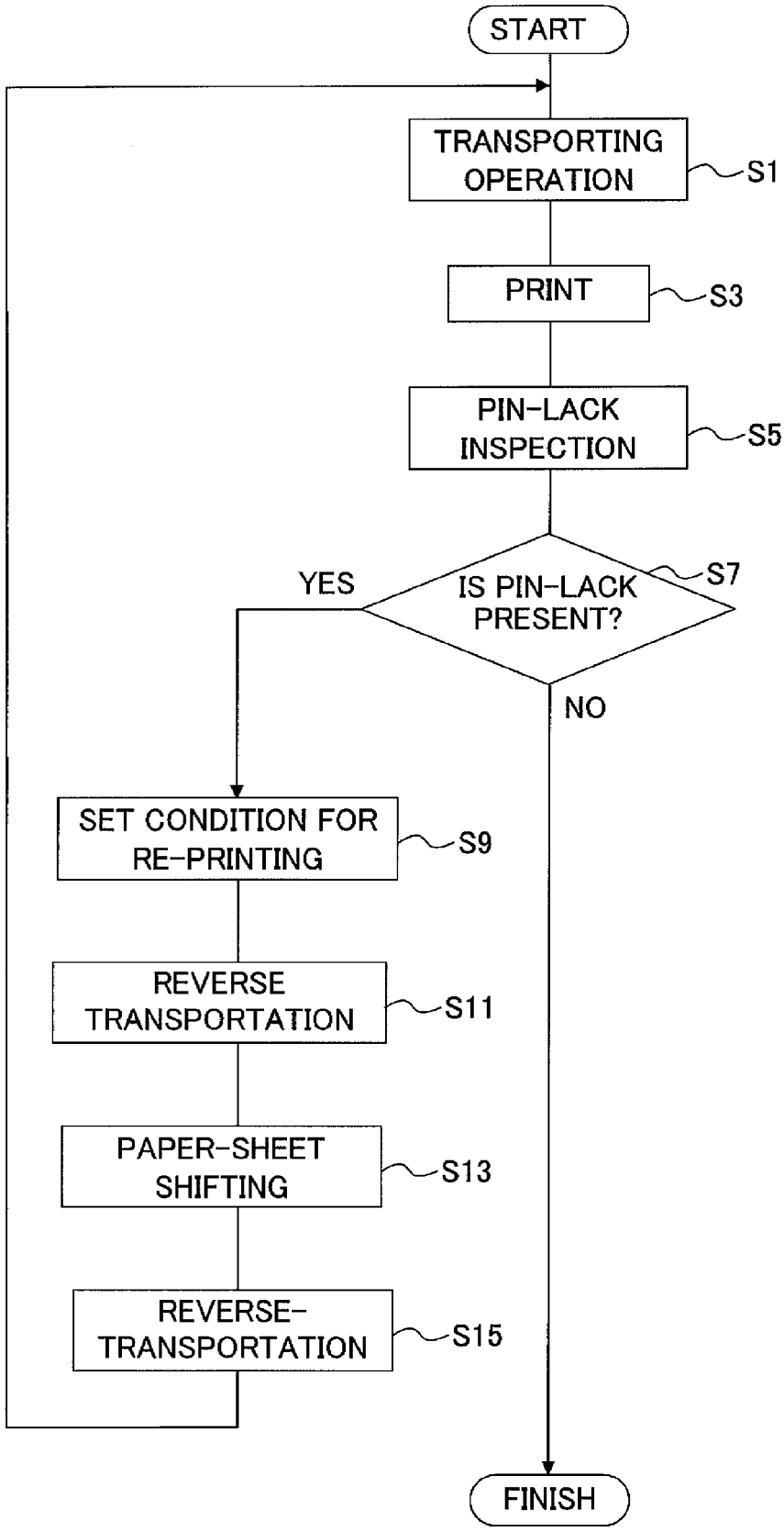
FIG. 9 is a flow chart showing steps of a controlling method for the ink discharge apparatus.
Figure 10B:
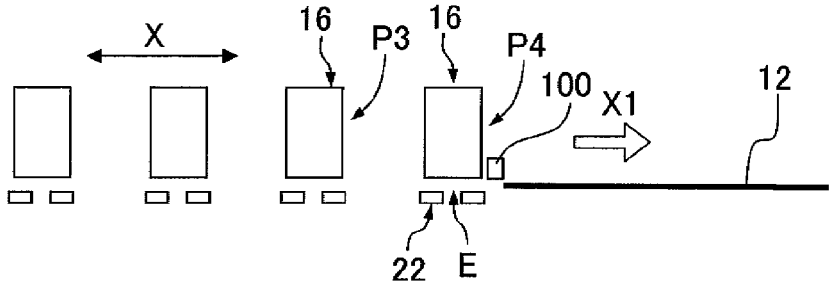

As shown in FIG. 9, when the printing operation is started based on a control signal of the controller (not shown), then firstly at Step S1, the normal transporting operation (regular feeding operation) by the transporting device 18 is started and the paper sheet 12 is transported to the "ink discharging positions E" corresponding to the head positions P1 to P4 respectively. Subsequently, at Step S3, ink discharging operation is performed by each of the ink-discharge line heads 16. As shown in FIG. 10B, when the ink discharging operation by the ink-discharge line head 16, among the ink-discharge line heads 16, positioned at the head position P4 that is the most downstream side in the normal transporting direction X1 is completed, then the paper sheet 12 is discharged or fed out from the "ink discharging position E" corresponding to this ink-discharge line head 16. In the embodiment, since Steps S1 and S3 are performed in integrated manner with respect to the paper sheet 12 so as to form an image on the paper sheet 12, Steps S1 and S3 are performed substantially concurrently as the "printing operation". Note that FIG. 10A shows a state that the paper sheet 12 is located at the start position of the Steps S1 and S3, and that FIG. 10B shows a state that the paper sheet 12 is located at the finish position of the Steps S1 and S3.

Then, at Step S5, detection is performed as to whether or not any "pin-lack" is present, based on the output of the pin-lack detector 100; and "presence or absence of pin-lack" is judged or determined at Step S7. As the pin-lack detector 100, for example, an image-information obtaining device which obtains information of the image (image information) formed on the paper sheet 12 by scanning the image formed on the paper sheet 12, and which detects the "pin-lack" based on the image information. If it is judged at Step S7 that "the pin-lack is absent", then the printing operation is finished. On the other hand, if it is judge at Step S7 that "the pin-lack is present", then "condition for re-printing" is set at Step S9. Namely, the judgment that "pin-lack is present" means that judgment is made for "performing the ink discharge again at a portion of the pin-lack". Note that the term "condition for re-printing" set at Step S9 means a variety of conditions for appropriately performing the re-printing based on the position of "pin-lack"; and that a "shift width of paper sheet 12" at Step S13 which will be described later is also included in the "condition for re-printing"

Figure 10C:
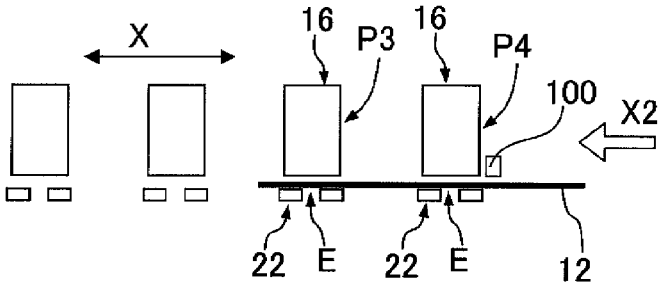

When the "condition for re-printing" is set at Step S9, then the paper sheet 12 is reversely transported by the transporting device 18 at Step S11 and the paper sheet 12 is returned back to the "ink discharging position E". Namely, the paper sheet 12 is transported in reverse or opposite direction (reverse transporting direction X2) which is reverse or opposite to the transporting direction at Step S1, and the paper sheet is placed again on the "paper-sheet placing surface N" of the platen 22 located below the "ink discharging position E". At this time, it is preferable that the position to which the paper sheet 12 is returned is a position at which the paper sheet 12 can be supported by a plurality of pieces of the attachment portion 80 of at least two of the platens 22. In the embodiment, two pieces of the platen 22 are provided with respect to one piece of the ink discharge head 16 (for each of the head positions P1 to P4); and the paper sheet 12 is transported back to a position at which the paper sheet 12 is supported by the attachment portions 80 of four pieces of the platens 22, as shown in FIG. 10C. Namely, the paper sheet 12 is supported by twenty four pieces of the attachment portions 80.

Subsequently, at Step S13, the paper sheet 12 is shifted in the line direction Y by the platen driving device 24 based on the "shift width of paper sheet 12" calculated at Step S9. Namely, at first, the platen 22 is lifted upwardly from the "first height H1" to the "second height H2" by the platen lifting/lowering device 62 as shown in FIG. 8C, and thus the paper sheet 12 placed on the platen 22 is lifted upwardly accompanying to this. Further, the attachment portions 80 of the platen 22 are moved by the platen driving device 24 in the line direction Y by an amount based on the above-described "shift width of paper sheet 12". The operation aspect during this movement is the "paper-sheet moving position" and the height of the platen 22 is held at the "second height H2". Namely, upon shifting the paper sheet 12 in the line direction Y, it is possible to reduce frictional resistance between the paper sheet 12 and the surface of the transporting belt 32, and to prevent the position of the paper sheet 12 from being shifted on the attachment portions 80 in non-desired or inappropriate manner. Further, as shown in FIG. 10C, in a case that the paper sheet 12 is supported by at least two platens 22, the paper sheet 12 is supported more stably than in a case that the paper sheet 12 is supported by one platen 22. Thus, it is possible to prevent the non-desired positional shift of the paper sheet 12, more assuredly.

When the operation for shifting the paper sheet 12 in the line direction Y is completed, the platen 22 is lowered to the "first height H1" by the platen lifting/lowering device 62. The position of the platen 22, when the lowering of the platen 22 is completed, is a position facing the nozzle surface 42*a* and is away from the "supporting position G1" in the line direction Y at which the platen 22 has been previously located before shifting the position of the platen 22. Provided that the "supporting position G1" before the positional shifting is a "first supporting position", then the "supporting position G1" after the positional shifting is thus referred to as a "second supporting position" in the meaning of supporting the paper sheet 12 upon performing the re-printing operation.

When the "paper-sheet shifting operation" at Step S13 is completed, then at Step S15, the paper sheet 12 is further transported in the reverse transporting direction X2 so as to return the paper sheet 12 to the start position of Step S1 (FIG. 10A). After that, the process is returned to Step S1, and the re-printing operation by the normal transporting operation (regular feeding operation) is performed so as to fill the "pin-lack".

In the embodiment, the presence or absence of the "pin-lack" is detected at Step S5, the presence or absence of the "pin-lack" is judged at Step S7, and the re-printing operation starting from Step S9 is performed if the "pin-lack" is present. However, for example, it is allowable to detect "resolution" of the image by the image-information obtaining device at Step S5 and to judge whether or not the "resolution" is appropriate at Step S7, and to execute the re-printing operation starting from Step S9 in a case that the "resolution" is less than a predetermined value. For example, assume a case that at Step S5 the image-information obtaining device detects the "resolution" as 300 dpi and that at Step S5 the detected resolution of 300 dpi is judged as lower than the predetermined value. In such a case, by shifting the paper sheet 12 by half pitch of the nozzle pitch (spacing distance between the nozzles) at the "paper-sheet shifting step" of Step S13 and by performing the re-printing with a resolution same as that of the initial (previous) printing, then it is possible to obtain an image of high resolution of 600 dpi. Further, it is also allowable to detect presence or absence of so-called "landing deviation" of the ink at Step S5, to judge the presence or absence of the "landing deviation" at Step S7, and to execute the re-printing operation starting from Step S9 in a case that the "landing deviation" is present. Furthermore, it is also allowable to detect at least two of the "pin-lack", the "resolution" and the "landing deviation" and to perform the above-described re-printing operations in combination based on the detection results. Note that the term so-called "landing deviation" means a phenomenon in which the ink is landed on and adhered onto the surface of the paper sheet 12 at a position deviated from an appropriate position, due to the lowering or loss of the function of the nozzle 14 caused by the adhesion of foreign matter, etc, or due to deviation in the ink-discharge direction caused by the surrounding environment (air flow, etc.) of the "ink discharging position E".

Further, in the embodiment, the "pin-lack detecting step" at Step S5 and the "pin-lack judging step" at Step S7 are performed after the "printing step" at Step S3. However, it is allowable to perform these "pin-lack detecting step" and "pin-lack judging step" before performing the printing operation (namely, before performing Step S1). In such a case, at the "pin-lack detecting step" of Step S5, there is not any image formed on the paper sheet 12. Therefore, the detection of the "pin-lack" is performed, for example, by a method in which the "preliminary discharge" is performed in a state that the paper sheet 12 does not exist at the "ink discharging position E" and the presence or absence of the ink discharge from each of the nozzles is observed by a camera, etc., so as to perform the detection, or by a method in which the above-described detection is performed electrically. Then, the re-printing operation is performed, after the "printing step" at Step S3, based on the judgment at Step S7 which has been previously performed; or the printing operation is finished.

Second Embodiment

Construction of Ink Discharge Apparatus According to the Second Embodiment

Figure 11A:
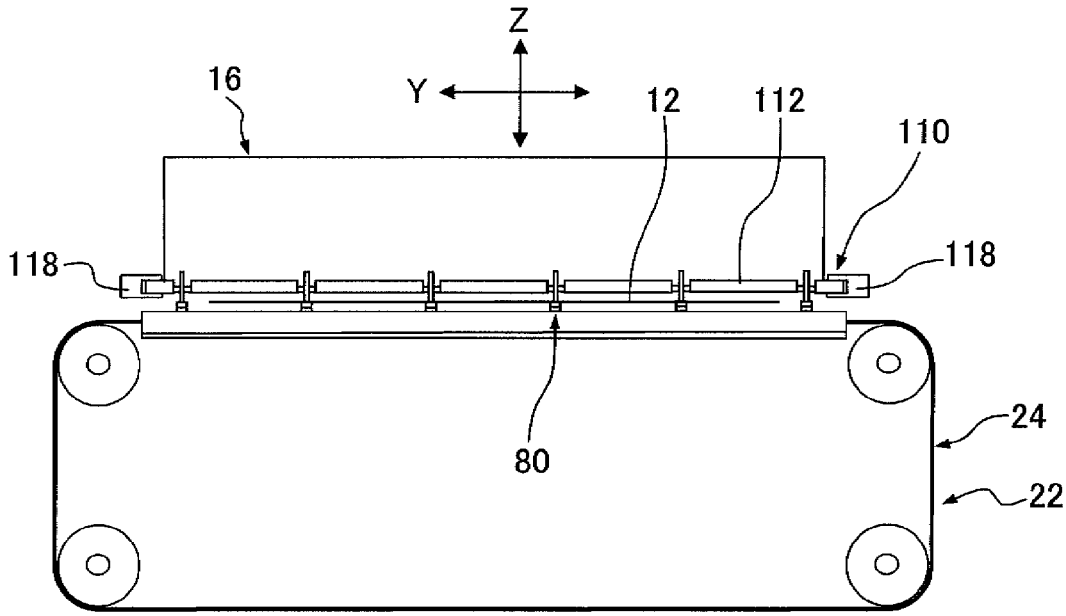
Figure 11B:
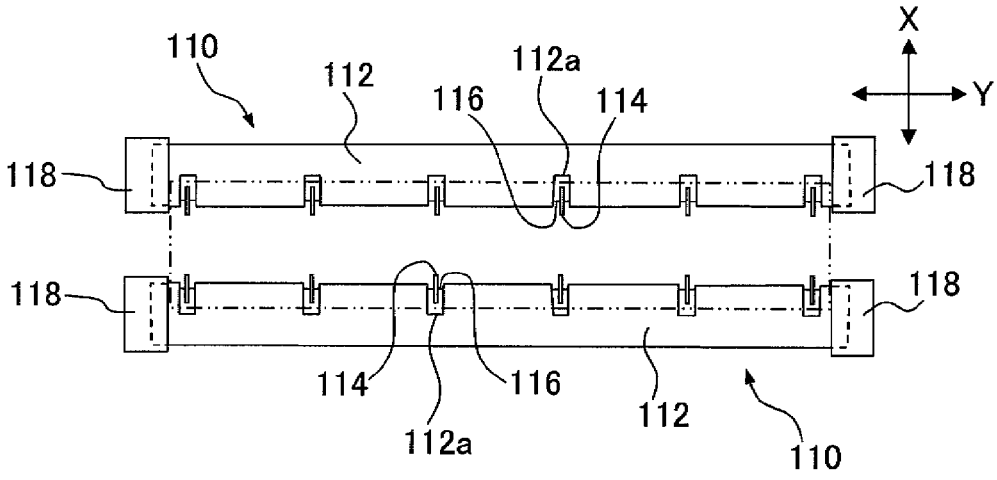
Figure 12A:
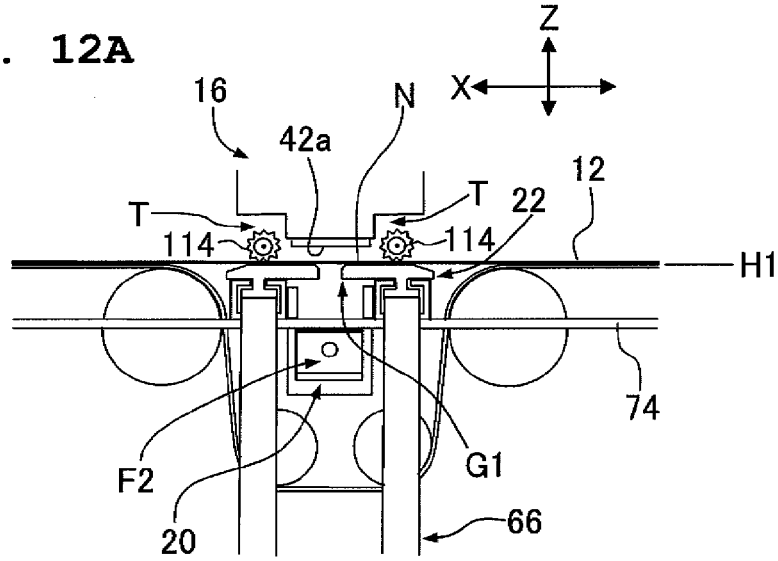

The ink discharge apparatus of the second embodiment is constructed in a similar manner as the ink discharge apparatus 10 of the first embodiment, except that a spur roller unit 110 is additionally provided on the ink discharge apparatus 10 of the first embodiment as shown in FIGS. 11A and 11B; that a space T is secured for arranging the spur roller unit 110 at a corner portion in the transporting direction X, the corner portion being located below or under the ink-discharge line head 16, as shown in FIG. 12A; and that the height of the platen 22 is adjusted at least in three steps.

To focus attention to one of the four head positions P1 to P4, as shown in FIG. 12A, one piece of the spur roller unit 110 is provided with respect to one piece of the platen 22 to face or be opposite to the platen 22. The spur roller unit 110 has one spur roller holder 112, six spur rollers 114 and six urging springs 116. The spur roller holder 112 is a plate-shaped member extending in the line direction Y; and both end portions of the spur roller holder 112 in the line direction Y are supported by holding members 118 to be movable in the line direction Y. Six recessed portions 112*a* are formed at one end in the width direction (namely, the transporting direction X) of the spur roller holder 112. The six recessed portions 112*a* are formed to be separated from one another with a spacing distance in the line direction Y, and the six spur rollers 114 are arranged in the six recessed portions 112*a*, respectively. Each of the spur rollers 114 is a substantially circular-plate shaped member (FIG. 12A) and has a plurality of protrusions at outer circumferential surface of the spur roller 114; and the protrusions are brought into contact with the paper sheet 12. The rotational axis of the spur roller 114 is formed to extend in the line direction Y. The six spur rollers 114 are held inside the recessed portions 112*a* via the urging springs 116 respectively such that each of the spur rollers 114 is movable inside one of the recessed portions 112*a* at least in the up and down direction, via one of the urging springs 116. The six spur rollers 114, in the spur roller unit 110, are arranged so that the six spur rollers 114 face or are opposite to the six placing portions 80 of the platen 22 formed the platen belts 66. Namely, one piece of the spur rollers 114 and one piece of the urging springs 116 correspond to one piece of the attachment portions 80 of the platen 22.

The spur roller units 110 is arranged at the space T defined below the ink-discharge line head 16. Although the spur roller holder 112 is held to be movable in the line direction Y by the holding members 118 as described above, the spur roller holder 112 is not constructed to be movable in the up and down direction. Therefore, the distance between the platen 22 and the spur rollers 114 can be adjusted by lifting and/or lowering the platen 22 with the platen lifting/lowering device 62.

<Operation of the Ink Discharge Apparatus According to the Second Embodiment>

Figure 8C:
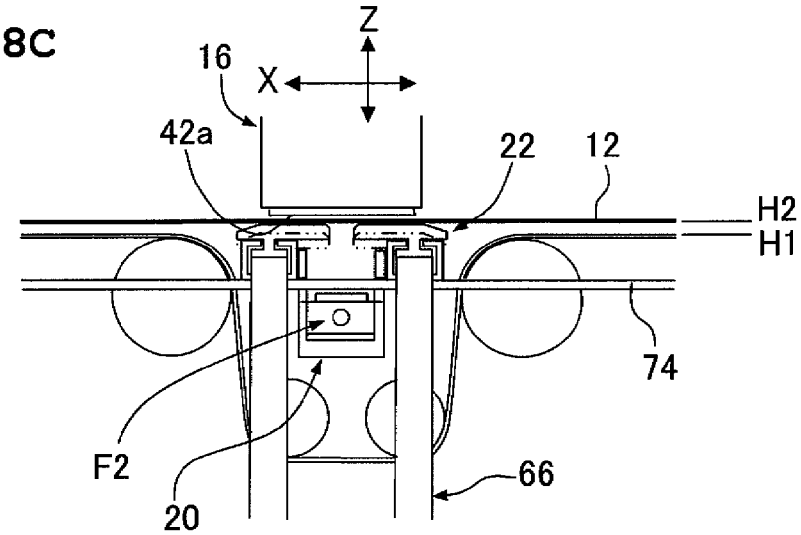
Figure 12B:
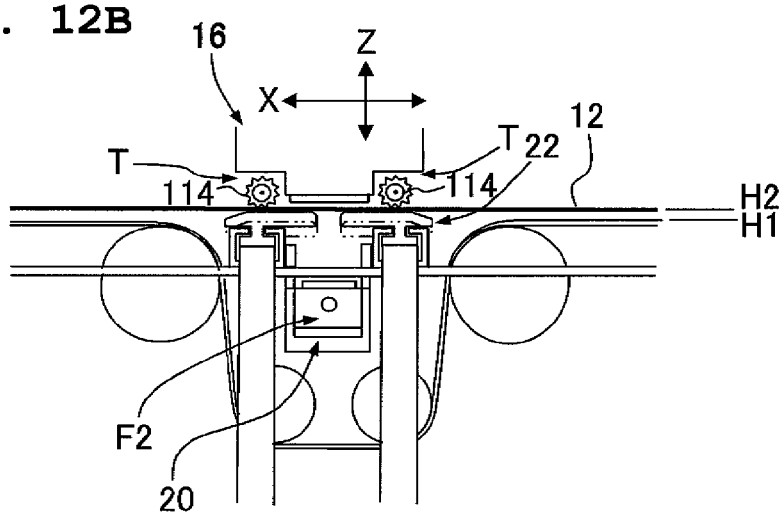

The "print position" shown in FIG. 12A corresponds to the "print position" of the first embodiment shown in FIG. 8A, and the "paper-sheet moving position" shown in FIG. 12B corresponds to the "paper-sheet moving position" of the first embodiment shown in FIG. 8C. The "platen retracting position" shown in FIG. 12C does not exist in the first embodiment. Note that a "cap position", which corresponds to the "cap position" of the first embodiment shown in FIG. 8B, exists also in the second embodiment. However, the "cap position" in the second embodiment is omitted in the drawings.

Figure 13:
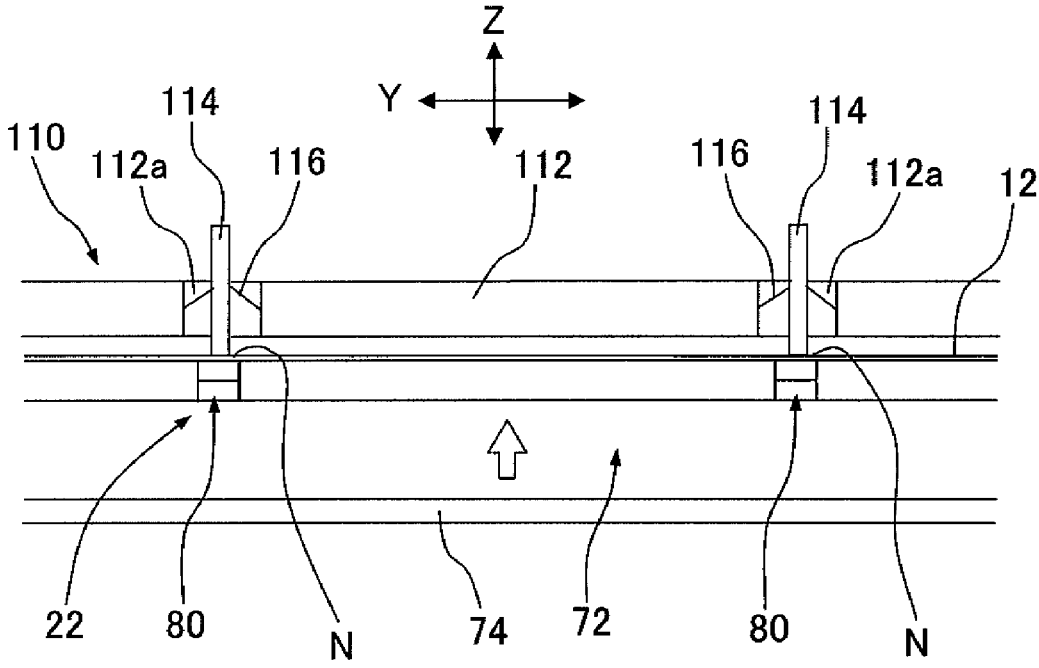
FIG. 13 is a side view showing a "paper-sheet moving position" in the ink discharge apparatus according to the second embodiment.

In the "print position" of the second embodiment, the platen 22 is supported at the "first height H1" as shown in FIG. 12A, and the spur rollers 114 are pressed against or to the paper-sheet placement surfaces N of the attachment portions 80 by the urging springs 116. Accordingly, upon performing the printing operation, the paper sheet 12 placed on the paper-sheet placement surfaces N can be appropriately pressed with the spur rollers 114. Upon performing transition from the "print position" to the "paper-sheet moving position", the platen 22 is lifted upwardly from the "first height H1" to the "second height H2" by the platen lifting/lowering device 62, and the platen 22 is supported at the "second height H2", as shown in FIG. 12B. Then, as shown in FIG. 13, the spur rollers 114 are moved further upwardly with respect to the spur roller holder 112 by being pressed with the paper-sheet placement surfaces N of the attachment portions 80, thereby further stretching or extending the urging springs 116 connecting the spur rollers 114 and the spur roller holder 112. With this, a restoration force of the urging springs 116 act on the spur rollers 114 in downward direction, and thus the force, of the spur rollers 114, pressing the paper sheet 12 becomes great. Therefore, upon shifting the paper sheet 12 in the line direction Y (Step S13 shown in FIG. 9), it is possible to prevent the paper sheet 12 from being shifted in non-desired manner with respect to the paper-sheet placement surfaces N of the attachment portions 80. Note that upon shifting the paper sheet 12 in the line direction Y, the entire spur roller holder 112 is shifted in the line direction Y together with the paper sheet 12.

Figure 12C:
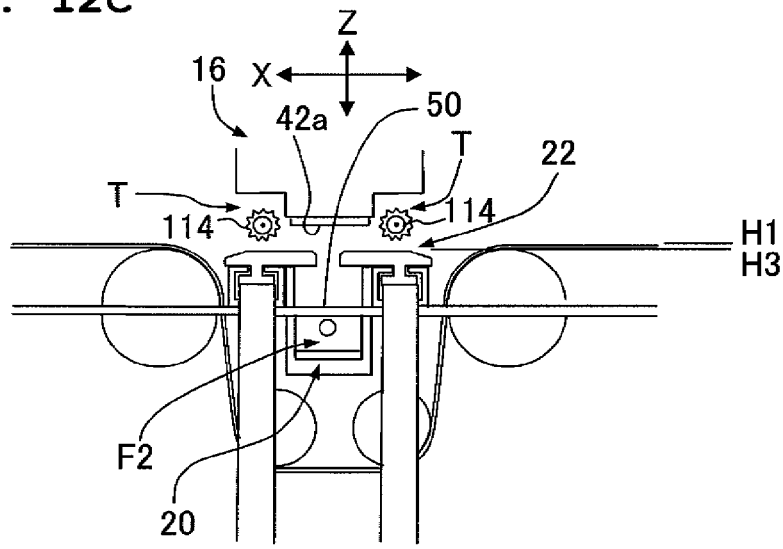

In the second embodiment, the spur rollers 114 are brought into contact with the paper-sheet placement surfaces N of the attachment portions 80 at the "print position". Accordingly, if the platen 22 is retracted to the "platen retracting position G2" (FIG. 5B) as it is, there is a fear that the platen 22 and the spur rollers 114 might be damaged due to the friction between the platen 22 and the spur rollers 114. In view of this, the "platen retracting position" is used upon retracting the platen 22. As shown in FIG. 12C, the "platen retracting position" is an aspect in which the platen 22 is supported at a "third height H3" away from the nozzle surface 42*a* more than the "first height H1" where the "supporting position G1" (FIG. 8A) exists, and in which the nozzle cap 50 is supported at the "cap retracting position F2". Upon performing transition from the "print position" to the "platen retracting position", the platen lifting/lowering device 62 (FIG. 6) is driven to thereby lower the platen 22 from the "first height H1" to the "third height H3". Since the platen 22 is moved away from the spur rollers 114 at "the platen retracting position", it is possible to prevent the platen 22 and the spur rollers 114 from being damaged due to the friction when the platen 22 is retracted.

Third Embodiment

Construction of Ink Discharge Apparatus According to the Third Embodiment

The ink discharge apparatus of the third embodiment is constructed in a similar manner as the ink discharge apparatus 10 of the first embodiment, except that a wiper 120 is additionally provided on each of the platen belt 66, as shown in FIG. 14.

Figure 14A:
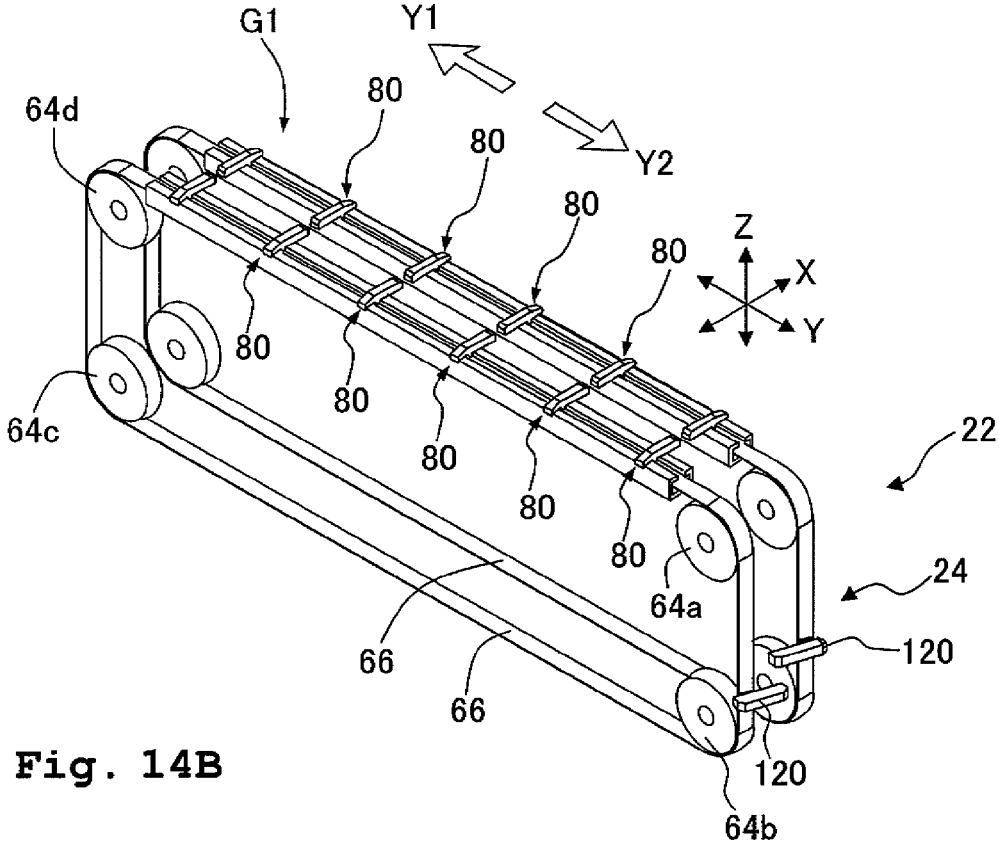
Figure 14B:
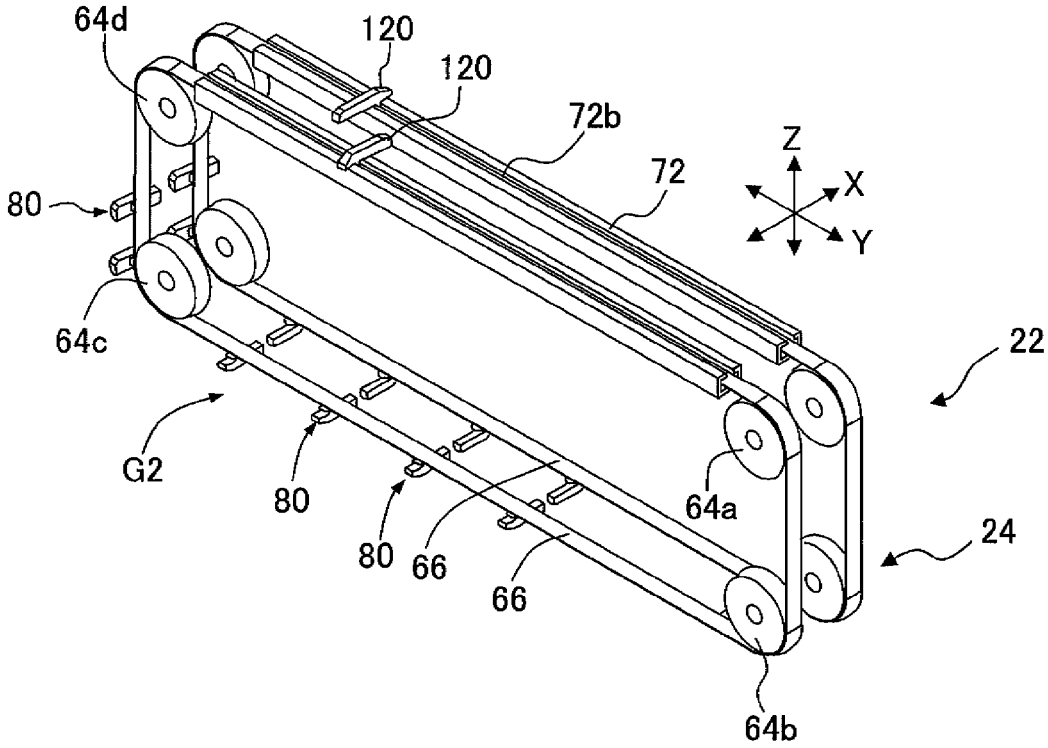

The ink discharge apparatus of the third embodiment is capable of performing a cleaning operation by bringing the wiper 120 into contact with the nozzle surface 42*a* to thereby remove, off the nozzle surface 42*a*, a stain or dirt such as the ink adhered to the nozzles surface 42*a*. The wiper 120 has a shape similar to that of the attachment portion 80 shown in FIG. 7, and the wiper 120 is formed, for example, of an elastic material such as rubber, a resin having flexibility (such as elastomer), etc. such that the nozzle surface 42*a* is hardly damaged or harmed and that the stain can be easily removed. One piece of the wiper 120 is provided on each of the platen belts 66. In this embodiment, since two pieces of the platens 22 are provided for one piece of the ink-discharge line heads 16, two pieces of the wipers 120 are provided with respect to one piece of ink-discharge line heads 16. As shown in FIG. 14 (FIGS. 14A and 14B), the width, of each of the two wipers 120, in the transporting direction X is longer than the that of the attachment portion 80, and the two wipers 120 extend in a direction facing each other. The two wipers 120 are shifted in the extending direction of the platen belts 66 such that the two wipers 120 do not contact with each other.

<Cleaning Operation of the Ink Discharge Apparatus According to the Third Embodiment>

In a case that the wiping of the nozzle surface 42*a* is performed while the attachment portions 80 of the platen 22 are positioned at the "supporting position G1" as shown in FIG. 14A, the platen 22 is driven by the platen driving device 24 so as to move the attachment portions 80 in a direction indicated by an arrow Y1 and to retract the attachment portions 80 to the "platen-retracting position G2". When the attachment portions 80 are moved from the "supporting position G1" to the "platen-retracting position G2", the wipers 120 are brought into contact with the nozzle surface 42*a* while passing through the "supporting position G1" as shown in FIG. 14B to thereby perform the wiping of the nozzle surface 42*a*. Therefore, the height of the wiper 120 is higher than that of the attachment portions 80 such that the wiper 120 can be brought into contact with the nozzle surface 42*a*. The two wipers 120 in the third embodiment have the width in the transporting direction X which is greater than that of the attachment portions 80, and the two wipers 120 are capable of cleaning the entire nozzle surface 42*a* thoroughly (without non-wiped portion). The nozzle area Q (FIG. 4), which is located in the nozzle surface 42*a* at the substantially central portion thereof in the transporting direction X, is a portion or place (location) which is provided with the nozzles 14 discharging the ink therethrough and which is most likely to be dirtied. In this embodiment, since the substantially central portion of the nozzle surface 42*a* is cleaned twice by the two wipers 120, the effect of the cleaning is high.

Further, in a case that the attachment portions 80 of the platen 22 are retracted from the "supporting position G1" to the "platen-retracting position G2" without performing the wiping of the nozzle surface 42*a*, it is allowable to drive the platen 22 with the platen driving device 24 so as to move the attachment portions 80 in a direction indicated by an arrow Y2 which is reverse or opposite to the direction adopted upon performing the cleaning operation. By doing so, the attachment portions 80 of the platen 22 can be retracted from the "supporting position G1" to the "platen-retracting position G2", without making the wiper 120 pass through the "supporting position G1".

In this embodiment, two pieces of the wiper 120 are provided with respect to one piece of the ink-discharge line heads 16. It is allowable, however, that the number of the wiper 120 is one. In such a case, the wiper 120 is provided on only one of the two platens 22 which are provided with respect to the ink-discharge line head 16; and it is preferable that the width of the wiper 120 in the transporting direction X is made to be sufficiently great such that the wiper 120 can clean the entire nozzle surface 42*a*.

Fourth Embodiment

Construction of Ink Discharge Apparatus According to the Fourth Embodiment

Figure 15A:
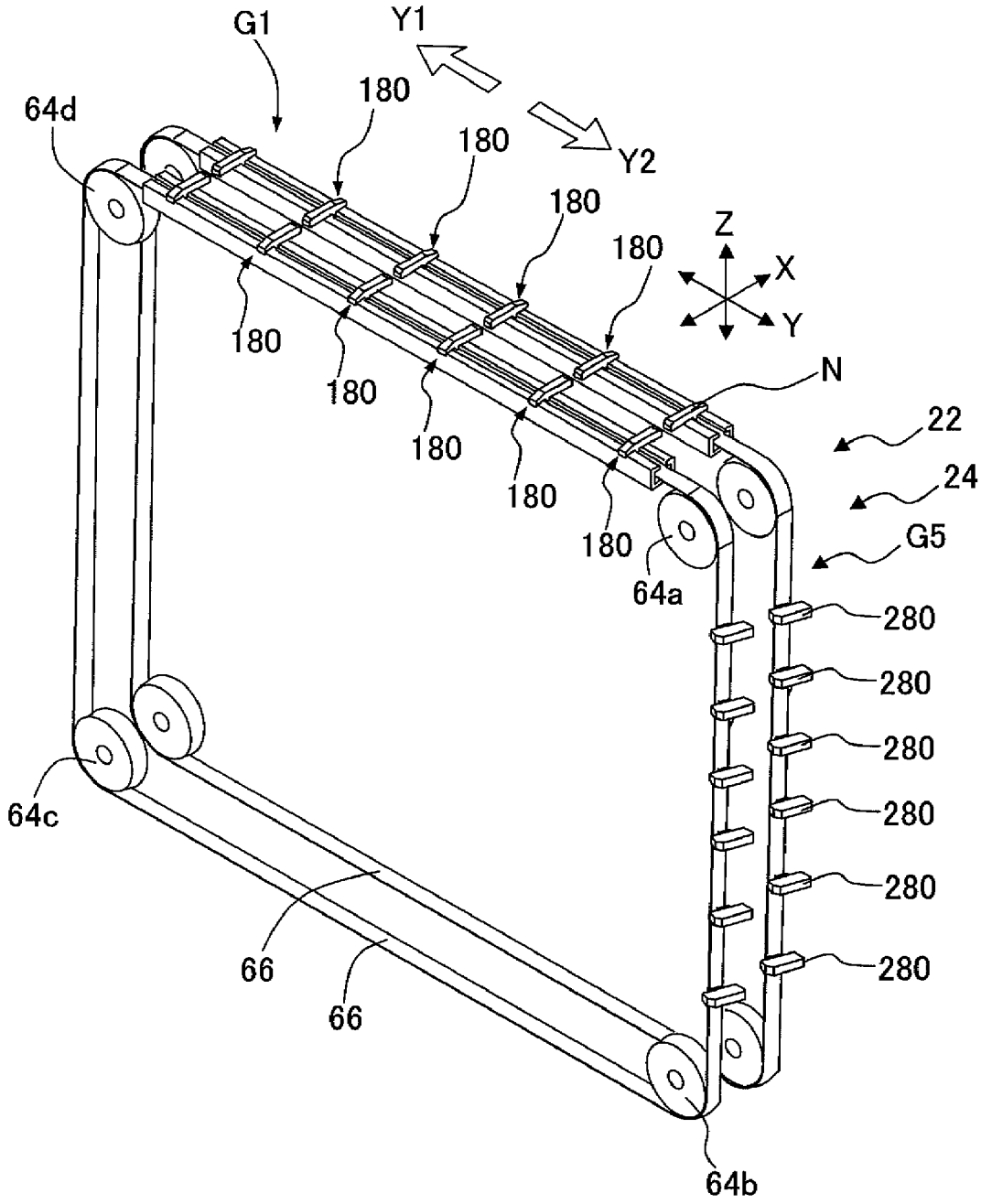

The ink discharge apparatus of the fourth embodiment is constructed in a similar manner as the ink discharge apparatus 10 of the first embodiment, except for the following points. Namely, as shown in FIG. 15A, first attachment portions 180 and second attachment portions 280 of which heights are different from each other are provided on the platen belts 66 of the ink discharge apparatus 10 of the first embodiment. Since the number of the attachment portions provided on each one of the platen belts 66 is increased from 6 pieces to 12 pieces, the platen belts 66 of the fourth embodiment are longer than the platen belts 66 of the first embodiment; and the distance between the platen belt pulleys 64*a*, 64*b* and the distance between the platen belt pulleys 64*c*, 64*d* of the platen driving device 24 in the fourth embodiment are longer than those in the first embodiment. In the fourth embodiment, four distances of the distance between the platen belt pulleys 64*a* and 64*b*, the distance between the platen belt pulleys 64*b* and 64*c*, the distance between the platen belt pulleys 64*e* and 64*d*, and the distance between the platen belt pulleys 64*d* and 64*a* are substantially same; and the platen belt 66 wound around the platen belt pulleys 64*a* to 64*d* forms a substantially square shape. Other than these, the remaining construction of the ink discharge apparatus of the fourth embodiment is similar to that of the ink discharge apparatus 10 of the first embodiment.

The first attachment portions 180 and the second attachment portions 280 have a shape similar to that of the attachment portions 80 of the first embodiment shown in FIG. 7. The first attachment portions 180 are different from the second attachment portions 280 in the height thereof, namely a distance in the height direction Z from the surface of the platen belt 66 to the paper-sheet placing surface N. The second attachment portions 280 are located higher than the first attachment portions 180. Namely, the paper-sheet placing surfaces N of the second attachment portions 280 are closer to the nozzle surface 42*a* of the ink discharge line head 16, than those of the first attachment portions 180.

<Operation of the Ink Discharge Apparatus According to the Fourth Embodiment>

Figure 15B:
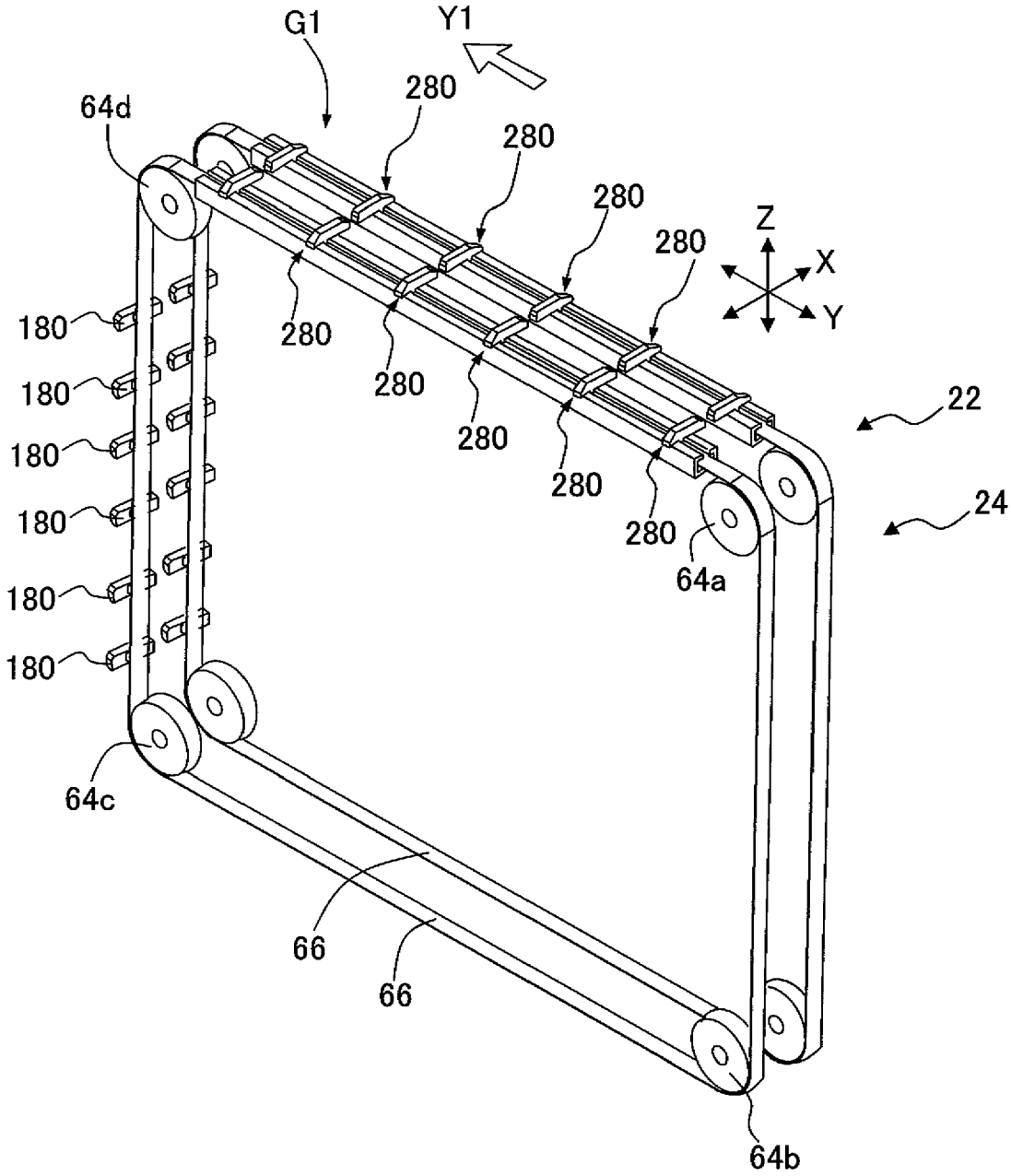

When the first attachment portions 180 of the platen 22 are located at the "supporting position G1", the second attachment portions 280 are located at a "third platen retracting position G5" between the platen belt pulleys 64*a* and 64*b*, as shown in FIG. 15A. From this state, when the platen 22 is driven by the platen driving device 24 to move the first attachment portions 180 in the direction indicated by the arrow Y1, then as shown in FIG. 15B, it is possible to position the second attachment portions 280 at the "supporting position G1" instead of the first attachment portions 180. In this manner, in the embodiment, the platen 22 is driven by the platen driving device 24 to thereby switch the attachment portions located or positioned at the "support position G1" between the first attachment portions 180 and the second attachment portions 280. By performing the switching between the first and second attachment portions 180 and 280 which are different in height, it is possible to change the distance between a print surface of the paper sheet 12 which is placed on the attachment portions 180 (280) and the nozzle surface 42*a* of the ink discharge line head 16. It is possible to change the distance from the nozzle surface 42*a* to the print surface of the paper sheet 12 to an appropriate distance depending on the width, material, kind, etc. of the paper sheet 12.

Figure 15C:
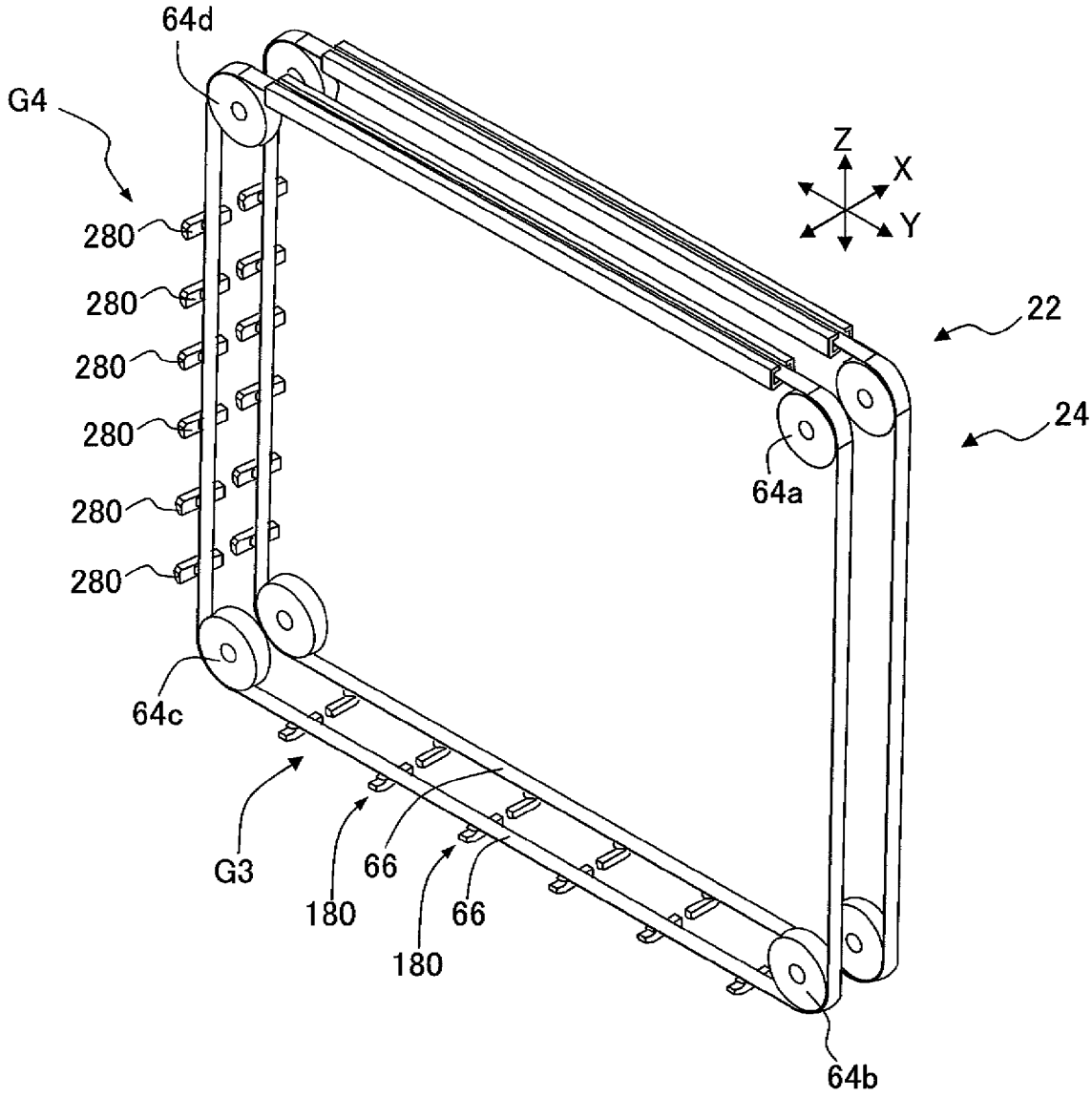

Further, it is possible to drive the platen 22 by the platen driving device 24 in the state shown in FIG. 15B to move the second attachment portions 280 in the direction indicated by the arrow Y1, and to retract both the first and second attachment portions 180, 280 from the "supporting position G1" as shown in FIG. 15C. At this time, the first attachment portions 180 are located at a "first platen retracting position G3" between the platen belt pulleys 64*b* and 64*c* and the second attachment portions 280 are located at a "second platen retracting position G4" between the platen belt pulleys 64*c* and 64*d*. The "first platen retracting position G3" corresponds to the "platen retracting position G2" in the first embodiment. In the fourth embodiment, since the number of the attachment portions is greater than that in the first embodiment, the "second platen retracting position G4" is provided in addition to the "first platen retracting position G3". Both of the "first platen retracting position G3" and the "second platen retracting position G4" are platen-retracting positions away from or out (outside) of the cap moving route S (FIG. 8A) along which the nozzle cap 50 moves. Therefore, upon covering the nozzle area Q (FIG. 4) with the nozzle cap 50, it is possible to prevent the nozzle cap 50 from colliding or bumping against the first attachment portions 180 and the second attachment portions 280.

Furthermore, in order to retract the first attachment portions 180 together with the second attachment portions 280 from the "supporting position G1", it is also allowable to drive the platen 22 by the platen driving device 24, in the state shown in FIG. 15A in which the first attachment portions 180 are positioned at the "supporting position G1", such that the first attachment portions 180 are moved in a direction indicated by an arrow Y2. By doing so, it is possible to retract the second attachment portions 280 to the "first platen retracting position G3" and to retract the first attachment portions 180 to the "third platen retracting position G5" which is shown in FIG. 15A. The "third platen retracting position G5" shown in FIG. 15A is also a platen retracting position which is away from or out of the cap moving route S along which the nozzle cap 50 is moved.

In the fourth embodiment, although the two kinds of attachment portions, namely the first and second attachment portions 180, 280 which are different in height, are provided on the platen belts 66, it is allowable to provide three or more kinds of attachment portions which are different from one another in height. Since the kinds of selectable attachment portions are greater, it is possible to further optimize the distance between the nozzle surface 42*a* to the print surface of the paper sheet 12. Further, although the four platen belt pulleys 64*a* to 64*d* are arranged such that the platen belt 66 wound around the platen belt pulleys 64*a* to 64*d* in a substantially square shape, it is allowable to change the arrangement and the number of the platen belt pulleys as necessary. For example, a construction is conceivable in which the number of the platen belt pulleys are increased and the platen belt is folded back a plurality of times such that the platen belt is made to travel along the platen belt pulleys in reciprocating manner. By adopting such construction, it is possible to accommodate a lengthy platen belt in a compact space.

In the first to fourth embodiments, two pieces of the platen 22 are provided for each of the ink discharge line heads 16. It is allowable, however, to provide one piece of the platen for each one of the head (liquid discharge head). In this case, for the purpose of stably supporting the paper sheet (discharge-objective), it is preferable to make the length, of the attachment portion, in the transporting direction X to be longer than that of the attachment portion 80 used in the first to fourth embodiments, or to use the spur roller 114 used in the second embodiment.

In the first to fourth embodiments, the platen 22 is provided as two pieces of the platens 22 for each of the four ink-discharge line head 16, namely 8 pieces in total of the platen 22 are provided; and these 8 pieces of the platen 22 are driven at the same time by the driving motor 70 (FIG. 1) of the platen driving device 24 via the shaft 68*a*. However, it is allowable that a construction is adopted in which the platens are driven individually from each other, namely each platen provided for one of the heads (liquid discharge heads) is driven separately or individually from other platens provided for the other heads. For example, a driving motor is provided for each of the platen corresponding to one of the heads. With this, in the third embodiment having the construction in which the wiper 120 is added to the platen belt 66, it is possible to perform the wiping of the nozzle surface for each of the heads.

Further, the ink discharge apparatus of the first to fourth embodiments may be provided with a wiping mechanism which wipes the ink, adhered to the nozzle surface 42*a*, from the nozzle surface 42*a* by a cleaning operation, etc., in addition to the wiping mechanism provided on the platen 22. In such a case, a wiper of the additional wiping mechanism is arranged such that the wiper does not hinder the ink discharge operation of the ink-discharge line head 16 during the printing operation. Upon performing the wiping operation, at first, the platen 22 is retracted, and then the wiper is moved by a lifting/lowering device (not shown) up to a position at which the wiper is brought into contact with the nozzle surface 42*a*. Afterwards, the wiper is slidably moved in the line direction Y to thereby remove the ink adhered to the nozzle surface 42*a*.

Further, the ink discharge apparatus of the second embodiment is constructed by providing the spur roller unit 110 on the ink discharge apparatus of the first embodiment; the ink discharge apparatus of the third embodiment is constructed by providing the wiper 120 on the ink discharge apparatus of the first embodiment; and the ink discharge apparatus of the fourth embodiment is constructed by providing the attachment portions 80 of the second embodiment on the ink discharge apparatus of the first embodiment. Each of the ink discharge apparatuses of the first to fourth embodiments may be an ink discharge apparatus which is provided with all and a plurality of the constructions of the second to fourth embodiments. For example, the ink discharge apparatus may be provided with all of the spur roller unit 110, the wiper 120 and the attachment portions 80 of the second embodiment at the same time.

What is claimed is:

1. A liquid discharge apparatus comprising:

a head comprising a nozzle surface comprising a plurality of nozzles which are open in the nozzle surface and through which a liquid is discharged toward an object;

a transporting device which transports the object relative to the nozzle surface in a transporting direction and which positions the object to face the nozzle surface;

a platen comprising a flexible or bendable portion and an attachment portion to which the object is attached, the attachment portion provided in the flexible or bendable portion; and a platen moving device which moves the platen in a direction orthogonal to the transporting direction and along the nozzle surface to position the attachment portion at a nozzle facing position facing the nozzle surface under the condition that the liquid is discharged toward the object.

2. The liquid discharge apparatus according to claim 1, wherein the platen includes a belt which has flexibility or bendability and in which the attachment portion is provided; and the liquid discharge apparatus further includes a platen supporting member which supports the attachment portion at the nozzle facing position.

3. The liquid discharge apparatus according to claim 2, wherein the platen moving device has a plurality of rollers; and the belt is wound around the rollers.

4. The liquid discharge apparatus according to claim 2, wherein the platen supporting member has a groove-shape and accommodates the belt inside the platen supporting member.

5. The liquid discharge apparatus according to claim 1, further comprising a nozzle cap which covers the nozzles and which is movable in a cap-moving route between a position at which the nozzle cap contacts with the nozzle surface to cover the nozzles and a position at which the nozzle cap is away from the nozzle surface;

wherein the platen moving device retracts the attachment portion to a retracting position which is out of the cap-moving route under the condition that the cap covers the nozzles.

6. The liquid discharge apparatus according to claim 5, wherein the platen moving device moves the attachment portion from the nozzle facing position in a first direction which is parallel to the nozzle surface and orthogonal to the transporting direction and then moves the attachment portion in a second direction which is not parallel to the nozzle surface to guide the attachment portion to the retracting position.

7. The liquid discharge apparatus according to claim 6, wherein the platen moving device moves the attachment portion from the nozzle facing position in the first direction and then moves the attachment portion in an opposite direction to the first direction to guide the attachment portion to the retracting position.

8. The liquid discharge apparatus according to claim 1, wherein two pieces of the platen are arranged with respect to one piece of the head; and an opening, via which the liquid discharged through the nozzles escapes to a side opposite to a side of the nozzles, is formed between the two of the attachment portions which are provided in each of two pieces of the platen.

9. The liquid discharge apparatus according to claim 1, wherein the platen moving devices moves the attachment portion between a first supporting position facing the nozzle surface and a second supporting position facing the nozzle surface, the second supporting position being away from the first supporting position in the direction orthogonal to the transporting direction.

10. The liquid discharge apparatus according to claim 9, further comprising a platen lifting/lowering device which lifts and lowers the platen to move the attachment portion between a first height at which the first supporting position and the second supporting position exist and a second height which is closer to the nozzle surface than the first height.

11. The liquid discharge apparatus according to claim 10, further comprising a spur roller which contacts with the attachment portion from a side of the nozzle surface at the first height and the second height, via the object attached to the attachment portion; and the platen lifting/lowering device moves the attachment portion to a third height which is further away from the nozzle surface than the first height and at which the spur roller is released from being contact with the attachment portion.

12. The liquid discharge apparatus according to claim 1, wherein the head is provided as a plurality of heads which are aligned at a spacing distance in the transporting direction; and the platen and the platen moving device are provided corresponding to each of the heads.

13. The liquid discharge apparatus according to claim 1, wherein the head is a line head which extends in the direction orthogonal to the transporting direction.

14. The liquid discharge apparatus according to claim 1, wherein the liquid discharged by the head forms an image on the object; and the liquid discharge apparatus further comprises an image-information obtaining device which obtains information of the image.

15. The liquid discharge apparatus according to claim 1, wherein the platen is provided with a wiper which contacts with the nozzle surface.

16. The liquid discharge apparatus according to claim 1, wherein the attachment portion includes a plurality of kinds of attachment portions of which heights are different.

17. A method for controlling a liquid discharge apparatus comprising a head comprising a nozzle surface comprising a plurality of nozzles which are open in the nozzle surface and through which a liquid is discharged toward an object; a transporting device which transports the object relative to the nozzle surface in a transporting direction and which positions the object to face the nozzle surface; a platen comprising a flexible or bendable portion and an attachment portion to which the object is attached, the attachment portion provided in the flexible or bendable portion; a platen moving device which moves the platen in a direction orthogonal to the transporting direction to position the attachment portion at a nozzle facing position facing the nozzle surface under the condition that the liquid is discharged toward the object; and a platen lifting/lowering device which lifts and lowers the platen, the method comprising the steps of:

(a) transporting the object by the transporting device to a liquid discharge position facing the nozzle surface, and discharging the liquid toward the object through the nozzles of the head;

(b) moving the object, to which the liquid is adhered, out of the liquid discharging position by the transporting device;

(c) judging whether or not the liquid is to be discharged again with the head toward the object to which the liquid is adhered;

(d) transporting the object by the transporting device in a direction opposite to the transporting direction in step (a), under the condition that judgment is made to discharge the liquid again in step (c), and returning the object to the liquid discharging position by the transporting device;

(e) lifting the object upwardly by the platen lifting/lowering device and then shifting a position of the object by moving the platen with the platen moving device in the direction orthogonal to the transporting direction;

(f) transporting the object, of which position is shifted in step (e), by the transporting device further to a starting position of step (a); and (g) transporting the object by the transporting device to a direction which is same as the transporting direction in step (a), and discharging the liquid again toward the object through a nozzle, among the plurality of nozzles, of the head.

18. The method according to claim 17, wherein step (c) is performed before step (a).

19. The method according to claim 17, wherein an image is formed on the object with the liquid discharged by the head in step (a);

the liquid discharge apparatus further comprises an image-information obtaining device which obtains information of the image; and judgment is made in step (c) whether or not the liquid is to be discharged again based on the information of the image.

20. A method for controlling a liquid discharge apparatus comprising a head comprising a nozzle surface comprising a plurality of nozzles which are open in the nozzle surface and through which a liquid is discharged toward an object; a transporting device which transports the object relative to the nozzle surface in a transporting direction and which positions the object to face the nozzle surface; a platen comprising a flexible or bendable portion and an attachment portion to which the object is attached, the attachment portion provided in the flexible or bendable portion; a platen moving device which moves the platen in a direction orthogonal to the transporting direction and along the nozzle surface to position the attachment portion at a nozzle facing position facing the nozzle surface under the condition that the liquid is discharged toward the object; and a nozzle cap which covers the nozzles and which is movable in a cap-moving route between a first position at which the nozzle cap contacts with the nozzle surface to cover the nozzles and a second position at which the nozzle cap is away from the nozzle surface, the method comprising the steps of:

discharging the liquid toward the object; and moving the attachment portion with the platen moving device in the direction orthogonal to the transporting direction and along the nozzle surface to retract the attachment portion to a retracting position which is out of the cap-moving route under the condition that the nozzle cap is positioned at the first position.

* * * * *